US010683830B2

(12) United States Patent
Ooiwa

(10) Patent No.: US 10,683,830 B2
(45) Date of Patent: Jun. 16, 2020

(54) FUEL VAPOR TREATMENT SYSTEM

(71) Applicant: DENSO CORPORATION, Kariya, Aichi-pref. (JP)

(72) Inventor: Hidetoshi Ooiwa, Kariya (JP)

(73) Assignee: DENSO CORPORATION, Kariya (JP)

( * ) Notice: Subject to any disclaimer, the term of this patent is extended or adjusted under 35 U.S.C. 154(b) by 306 days.

(21) Appl. No.: 15/718,779

(22) Filed: Sep. 28, 2017

(65) Prior Publication Data

US 2018/0100470 A1 Apr. 12, 2018

(30) Foreign Application Priority Data

Oct. 7, 2016 (JP) ..... 2016-198656

(51) Int. Cl.
*F02M 25/08* (2006.01)

(52) U.S. Cl.
CPC .... *F02M 25/0809* (2013.01); *F02M 25/0836* (2013.01); *F02M 25/0854* (2013.01); *F02M 25/0872* (2013.01)

(58) Field of Classification Search
CPC ..... F02M 25/0809; F02M 25/0818; F02M 25/0836; F02M 25/0872
See application file for complete search history.

(56) References Cited

U.S. PATENT DOCUMENTS 5,143,035 A * 9/1992 Kayanuma ..... F02M 25/08 123/198 D
5,284,050 A * 2/1994 Iida ..... F02M 25/0809 73/114.39
5,398,661 A * 3/1995 Denz ..... B60K 15/03504 123/198 D
5,400,759 A * 3/1995 Ishida ..... F02M 25/0809 123/198 D
5,445,015 A * 8/1995 Namiki ..... F02M 25/0809 73/114.39
2002/0184942 A1* 12/2002 Isobe ..... F02M 25/0809 73/114.41
2003/0226549 A1 12/2003 Takagi et al.
2006/0130568 A1 6/2006 Ishii et al.
2009/0204309 A1* 8/2009 Eser ..... F02M 25/0809 701/102
2013/0184963 A1 7/2013 Jackson et al.
2015/0013437 A1* 1/2015 Takakura ..... F02M 25/0818 73/40.5 R (Continued)

*Primary Examiner* — Sizo B Vilakazi
*Assistant Examiner* — Anthony L Bacon
(74) *Attorney, Agent, or Firm* — Nixon & Vanderhye P.C.

(57) ABSTRACT

A tank passage has one end connected to a fuel tank. A purge passage has one end connected to a canister and the other end connected to an intake passage. An atmospheric passage has one end connected to the canister and the other end communicated with the atmosphere. A purge valve opens and closes the purge passage. An atmospheric valve opens and closes an atmospheric passage. A tank switch valve opens and closes the tank passage. A pressure sensor detects pressure in the purge passage and outputs a signal corresponding to the detected pressure. An abnormality detection portion executes an abnormality detection processing that detects a clog abnormality based on a signal from a pressure sensor when the tank switch valve is activated in a state in which the purge valve and the atmospheric valve are closed, after driving of an engine is stopped.

14 Claims, 11 Drawing Sheets

(56) References Cited

U.S. PATENT DOCUMENTS

| | | | | |
|---|---|---|---|---|
| 2015/0020780 | A1* | 1/2015 | Takakura | F02M 25/0809 123/520 |
| 2015/0040645 | A1* | 2/2015 | Takakura | F02M 25/0818 73/47 |
| 2016/0215713 | A1* | 7/2016 | Dudar | F02D 41/0032 |
| 2016/0265480 | A1* | 9/2016 | Fukui | F02M 25/0809 |
| 2016/0356247 | A1* | 12/2016 | Dudar | F02M 25/0827 |
| 2017/0030303 | A1* | 2/2017 | Takakura | F02M 25/089 |
| 2017/0342946 | A1* | 11/2017 | Sager | F02M 25/0827 |
| 2018/0017022 | A1* | 1/2018 | Murata | F02M 25/0809 |
| 2018/0171938 | A1* | 6/2018 | Watanabe | F02M 25/0818 |
| 2019/0271273 | A1* | 9/2019 | Dudar | B60K 15/03519 |

* cited by examiner

FUEL VAPOR TREATMENT SYSTEM

CROSS REFERENCE TO RELATED APPLICATION

This application is based on Japanese Patent Application No. 2016-198656 filed on Oct. 7, 2016, the disclosure of which is incorporated herein by reference.

TECHNICAL FIELD

The present disclosure relates to a fuel vapor treatment system that treats a fuel vapor in a fuel tank, in particular relates to a fuel vapor treatment system capable of detecting an abnormality in the fuel vapor treatment system.

BACKGROUND

A fuel vapor treatment system that discharges a fuel vapor in a fuel tank into an intake passage of an internal combustion engine and treats the fuel vapor has been known. In recent years, regulations of the fuel vapor leaked from an inside of the fuel tank to an outside become strict. In particular, according to a standard of the United States Environmental Protection Agency (EPA) and the United States California Air Resources Board (CARB), it is required to detect the leakage of the fuel vapor from a fine hole of the fuel tank.

An fuel vapor treatment system disclosed in JP 2006-177199 A includes a tank passage that connects a fuel tank and a canister, a purge passage that connects the canister and an intake passage, an atmospheric passage that connects the canister and the atmosphere, a purge valve that can open and close the purge passage, an atmospheric valve that can open and close the atmospheric passage, and a pressure sensor that can detect pressure in the purge passage. After an internal combustion engine is stopped, the fuel vapor treatment system closes the atmospheric passage and the purge passage so that a leak abnormality that is "an abnormality of leakage of an fuel vapor from the fuel tank, the tank passage and the like to an outside" can be detected based on a signal from the pressure sensor after a predetermined time has elapsed.

In the fuel vapor treatment system described above, the liquefied fuel vapor or a foreign substance is retained in the tank passage and thereby the tank passage might be clogged. However, in the fuel vapor treatment system, the pressure sensor is arranged in the purge passage, namely on an opposite side to the fuel tank with respect to the tank passage. Thus, when the tank passage is clogged, the clog cannot be detected by the pressure sensor. When the tank passage is clogged, the pressure in the fuel tank is increased and a valve body, which closes a fuel supply port or the like, is opened, broken or the like, and therefore the fuel vapor might be leaked from the fuel supply port to the outside.

SUMMARY

It is an object of the present disclosure to provide a fuel vapor treatment system capable of detecting a clog abnormality of a tank passage.

A fuel vapor treatment system according to the present disclosure is capable of discharging a fuel vapor generated from a fuel evaporated in a fuel tank into an intake passage of an internal combustion engine of a vehicle and capable of processing the fuel vapor. The fuel vapor treatment system includes a tank passage, a canister, a purge passage, an atmospheric passage, a purge valve, an atmospheric valve, a tank switch valve, a pressure sensor, and an abnormality detection portion.

One end of the tank passage is connected to the fuel tank.

The canister is connected to the other end of the tank passage and can absorb the fuel vapor generated in the fuel tank.

One end of the purge passage is connected to the canister, and the other end of the purge passage is connected to the intake passage.

One end of the atmospheric passage is connected to the canister, and the other end of the atmospheric passage is communicated with the atmosphere.

The purge valve can open and close the purge passage.

The atmospheric valve can open and close the atmospheric passage.

The tank switch valve can open and close the tank passage.

The pressure sensor detects pressure in the tank passage, the canister, the purge passage, or the atmospheric passage and outputs a signal corresponding to the detected pressure.

The abnormality detection portion executes abnormality detection processing that can detect a clog abnormality, which is "an abnormality of the tank passage being clogged", based on the signal from the pressure sensor when the tank switch valve is activated in a state in which the purge valve and the atmospheric valve are closed, after driving of the internal combustion engine is stopped.

In the present disclosure, when the clog abnormality does not occur in the tank passage and the tank switch valve is activated to be closed in a state in which the purge valve and the atmospheric valve are closed in the abnormality detection processing, it is considered that a change rate of the pressure detected by the pressure sensor is changed between the times before and after the tank switch valve is closed. On the other hand, when the clog abnormality occurs in the tank passage and the tank switch valve is activated to be closed in a state in which the purge valve and the atmospheric valve are closed in the abnormality detection processing, it is considered that the change rate of the pressure detected by the pressure sensor is not substantially changed between the times before and after the tank switch valve is closed. Accordingly, the abnormality detection portion detects the clog abnormality when the change rate of the pressure detected by the pressure sensor is not substantially changed between the times before and after the tank switch valve is closed in the abnormality detection processing.

In this way, the present disclosure further includes the tank switch valve compared to the conventional technique, and therefore the present disclosure can detect the clog abnormality based on the signal from the pressure sensor when the tank switch valve is activated in the abnormality detection processing.

DETAILED DESCRIPTION

Hereinafter, fuel vapor treatment systems according to embodiments are described with reference to drawings. The same numeral reference is assigned to substantially the same part between the embodiments, and the description thereof is therefore omitted.

First Embodiment

Figure 1:
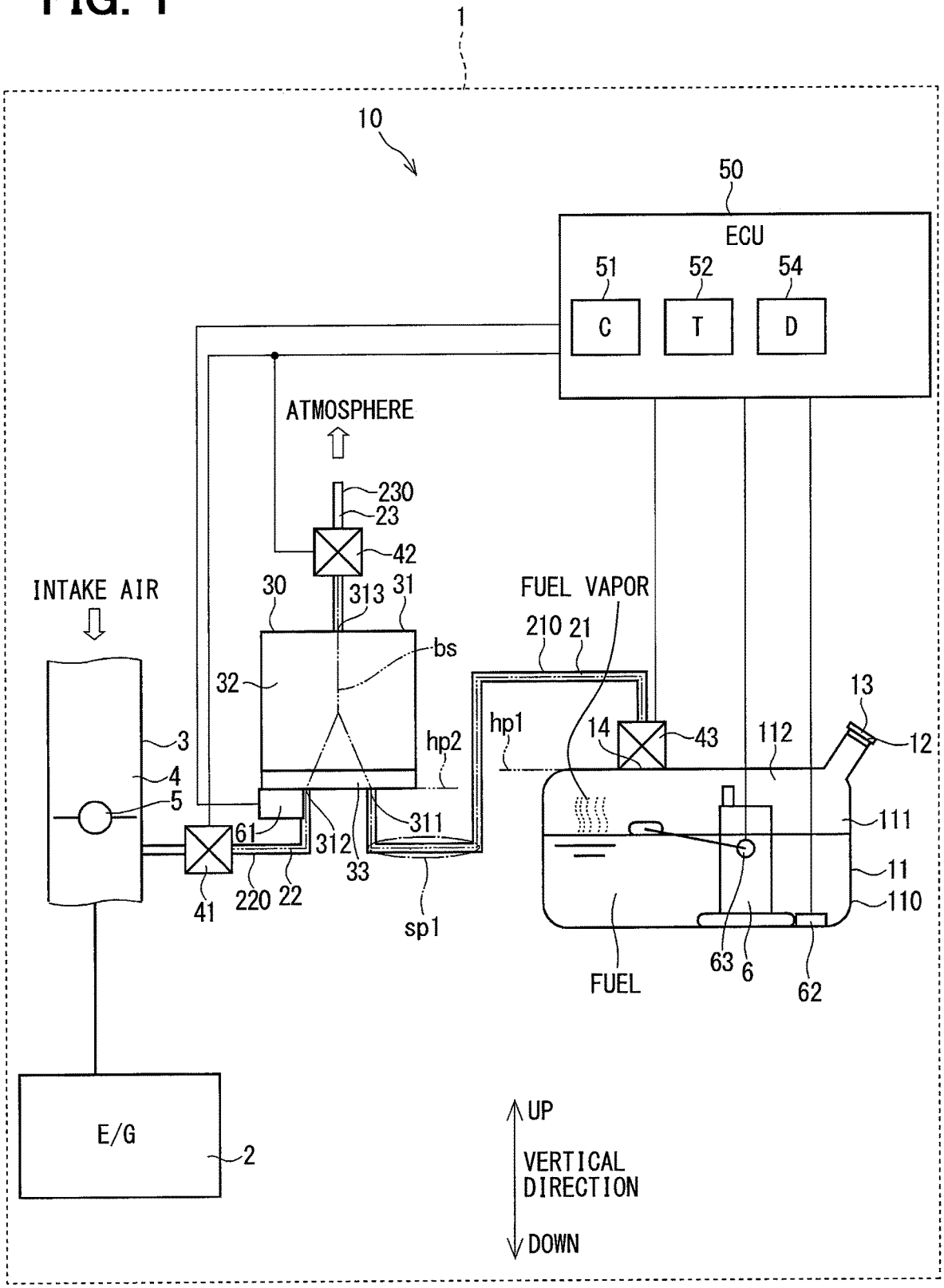
FIG. 1 is a schematic view illustrating a fuel vapor treatment system according to a first embodiment.

FIG. 1 illustrates a fuel vapor treatment system according to a first embodiment.

A fuel vapor treatment system 10 according to the first embodiment is applied to a vehicle 1 having an engine 2 as an internal combustion engine.

The vehicle 1 includes the engine 2, an intake pipe 3, a fuel tank 11, the fuel vapor treatment system 10, and the like.

The vehicle 1 travels by means of driving force generated by driving of the engine 2. The engine 2 is driven, for example, when gasoline as fuel is supplied. That is, the engine 2 is a gasoline engine.

The intake pipe 3 is connected to the engine 2. An intake passage 4 is formed in the intake pipe 3. One end of the intake passage 4 is connected to a combustion chamber of the engine 2 and the other end of the intake passage 4 is communicated with the atmosphere. The intake passage 4 introduces atmospheric air to the combustion chamber of the engine 2. The air (hereinafter, referred to as "intake air") suctioned into the combustion chamber through the intake passage 4 is mixed with, for example, fuel injected from a fuel injection valve or the like, and thereby a mixture is formed. The mixture is combusted in the combustion chamber and thereby the engine 2 operates, namely the engine 2 is driven.

A throttle valve 5 is arranged in the intake passage 4. The throttle valve 5 can adjust an amount of the intake air suctioned into the engine 2 by opening and closing the intake passage 4.

The fuel tank 11 stores the fuel to be supplied to the engine 2. A fuel pump 6 is arranged in the fuel tank 11. The fuel pump 6 suctions the fuel in the fuel tank 11 and pressurizes and discharges the fuel. The fuel discharged from the fuel pump 6 is supplied to the engine 2 through a pipe, a fuel rail, and a fuel injection valve which are not shown.

The fuel tank 11 includes a tank body 110, a tank cap 13, and the like.

The tank body 110 is formed in a box shape by, for example, metal or the like. The tank body 110 has a tank inner space 111 in which the fuel is stored.

The tank body 110 has a fuel supply port 12 formed therein. The fuel supply port 12 is formed to communicate the tank inner space 111 with an outside of the tank body 110. The fuel supply port 12 is arranged at an upper side of the tank body 110 in a vertical direction in a state in which the fuel tank 11 is mounted in the vehicle 1. The fuel supply port 12 is formed such that a fuel supply gun (not shown) is inserted into the fuel supply port 12. Accordingly, the fuel can be supplied into the tank inner space 111 of the fuel tank 11 from the fuel supply gun inserted into the fuel supply port 12, namely, the fuel supply is performed.

The tank cap 13 is disposed adjacent to the fuel supply port 12 to open and close the fuel supply port 12.

The tank body 110 has an opening portion 14 formed therein. The opening portion 14 is formed to communicate the tank inner space 111 with the outside of the tank body 110. The opening portion 14 is arranged at an upper side of the tank body 110 in the vertical direction in a state in which the fuel tank 11 is mounted in the vehicle 1.

When the fuel is stored in the fuel tank 11, the fuel in the fuel tank 11 is evaporated and thereby a fuel vapor is generated in the tank inner space 111.

The fuel vapor treatment system 10 is a system for treating the fuel vapor generated in the fuel tank 11.

The fuel vapor treatment system 10 includes a tank passage 21, a canister 30, a purge passage 22, an atmospheric passage 23, a purge valve 41, an atmospheric valve 42, a tank switch valve 43, an electronic control unit (hereinafter, referred to as "ECU") 50, a pressure sensor 61, a temperature sensor 62, a fuel level sensor 63, and the like.

In the present embodiment, the fuel vapor treatment system 10 includes a tank passage member 210, a purge passage member 220, and an atmospheric passage member 230. Each of the tank passage member 210, the purge passage member 220, and the atmospheric passage member 230 is formed in a tubular shape by, for example, metal or the like.

The tank passage member 210 is formed such that one end of the tank passage member 210 is connected to the opening portion 14 of the fuel tank 11. The tank passage 21 is formed in the tank passage member 210. With this, one end of the tank passage 21 is communicated with the tank inner space 111 of the fuel tank 11 through the opening portion 14. Accordingly, the fuel vapor generated in the fuel tank 11 enters into the tank passage 21 through the opening portion 14.

The canister 30 includes a case 31, an absorbent 32, and the like. The case 31 is formed in a box shape by, for example, a resin or the like. The case 31 has case openings 311, 312, 313 formed therein. Each of the case openings 311, 312, 313 is formed to communicate an inside of the case 31 with an outside of the case 31.

The absorbent 32 is arranged in the case 31. The case opening 311 and the case opening 312 are arranged opposite to the case opening 313 with respect to the absorbent 32 in the case 31. The absorbent 32 is arranged on a side of the case opening portion 313 in the case 31. Thus, the case 31 has a space 33 formed on a side of the case openings 311, 312. The case opening 311 is communicated with the case opening 312 through the space 33. Thus, an air-flow resistance of the space 33 between the case opening 311 and the case opening 312 in the canister 30 is set to substantially zero, namely set to be equal to or less than a predetermined value.

The case opening 311 of the canister 30 is connected to the other end of the tank passage member 210. With this, the other end of the tank passage 21 is communicated with the inside of the case 31 through the case opening 311. Thus, the fuel vapor generated in the fuel tank 11 enters into the inside (the space 33) of the case 31 of the canister 30 through the opening 14 of the fuel tank 11, the tank passage 21, and the case opening 311.

The absorbent 32 is formed of, for example, an activated carbon that can absorb the fuel vapor. Thus, the absorbent 32 can absorb the fuel vapor generated in the fuel tank 11 and entered into the inside (the space 33) of the case 31 through the case opening portion 311.

The purge passage member 220 is arranged such that one end of the purge passage member 220 is connected to the case opening 312 of the canister 30 and the other end of the purge passage member 220 is connected to an opening portion of the intake pipe 3. The purge passage 22 is formed in the purge passage member 220. With this, one end of the purge passage 22 is communicated with the inside (the space 33) of the case 31 of the canister 30 through the case opening 312. The other end of the purge passage 22 is communicated with the intake passage 4 through the opening of the intake pipe 3. Thus, the fuel vapor in the space 33 of the canister 30 is introduced into the intake passage 4 through the purge passage 22.

One end of the atmospheric passage member 230 is connected to the case opening 313 of the canister 30, and the other end of the atmospheric passage member 230 is communicated with the atmosphere. The atmospheric passage 23 is formed in the atmospheric passage member 230. With this, one end of the atmospheric passage 23 is communicated with the inside of the case 31 through the case opening 313. The other end of the atmospheric passage 23 is communicated with the atmosphere.

The fuel vapor entered into the case 31 from the case opening 311 is passed through the absorbent 32 toward the case opening 313. At this time, the fuel vapor is absorbed by the absorbent 32. Thus, a concentration of the fuel vapor contained in the air discharged to the atmosphere from the atmospheric passage 23 is equal to or lower than a predetermined concentration.

In the present embodiment, the tank passage 21 has a specific part sp1. The specific part sp1 is located lower than a horizontal plane hp1 that passes the one end of the tank passage 21 and a horizontal plane hp2 that passes the other end of the tank passage 21 in the vertical direction in a state in which the fuel vapor treatment system 10 is mounted in the vehicle 1 (see FIG. 1). Thus, the liquefied fuel vapor or a foreign substance is apt to be retained at the specific part sp1. Accordingly, the tank passage 21 might be clogged especially at the specific part sp1. "The clog of the tank passage 21" denotes, for example, a state of the tank passage 21 in which the liquefied fuel vapor or the foreign substance is retained at a part of the tank passage 21 and thereby a flow of liquid in the tank passage 21 is interrupted. "The clog of the tank passage 21" includes a complete clog state of the tank passage 21 in which the flow of the liquid in the tank passage 21 is completely interrupted and an incomplete clog state of the tank passage 21 in which the flow of the liquid is slightly allowed. Hereinafter, "the clog" denotes the similar state.

An illustration of the vertical direction in FIG. 1 is applied to the fuel tank 11 and the tank passage 21. That is, for example, the canister 30 is mounted and arranged in the vehicle 1 regardless of the illustration of the vertical direction in FIG. 1.

The purge valve 41 is arranged in the purge passage member 220 and can open and close the purge passage 22. In the present embodiment, the purge valve 41 is formed as a so-called normally close type valve device that is set to be closed when non-energized.

The atmospheric valve 42 is arranged in the atmospheric passage member 230 and can open and close the atmospheric passage 23. In the present embodiment, the atmospheric valve 42 is formed as a so-called normally open type valve device that is set to be opened when non-energized.

The tank switch valve 43 is arranged in the tank passage member 210 and can open and close the tank passage 21. In the present embodiment, the tank switch valve 43 is formed as a so-called normally open type valve device that is set to be opened when non-energized.

In the present embodiment, the tank switch valve 43 is arranged to be contacted with the fuel tank 11 or to be adjacent to the fuel tank 11. That is, the tank switch valve 43 is arranged on a side of the fuel tank 11 with respect to the specific part sp1.

The ECU 50 is formed as a small size computer provided with a CPU as a calculation means, a ROM, a RAM, and an EEPROM as a storage means, an I/O as an input and output means, and the like. The ECU 50 executes calculation in accordance with a program stored in the ROM or the like based on information such as signals from various sensors mounted at respective parts in the vehicle 1 and controls operation of various devices and apparatuses in the vehicle 1.

The ECU 50 includes a control portion 51, a fuel vapor treating portion 52, and an abnormality detection portion 54.

The control portion 51 can control the operation of the throttle valve 5, the fuel pump 6, the fuel injection valve, or the like, based on the information such as the signals from the various sensors. Thus, the control portion 51 can control an amount of the intake air suctioned into the engine 2, an amount of the fuel supplied to the fuel injection valve from the fuel tank 11, and an amount of the fuel supplied to the engine 2 from the fuel injection valve.

The control portion 51 can control the operation of the purge valve 41, the atmospheric valve 42, and the tank switch valve 43. Thus, the control portion 51 can control an open and close state of the purge valve 41 (the purge passage 22), the atmospheric valve 42 (the atmospheric passage 23), and the tank switch valve 43 (the tank passage 21).

When all of the purge valve 41, the atmospheric valve 42, and the tank switch valve 43 are closed, a space between the tank switch valve 43, the purge valve 41, and the atmospheric valve 42 is closed. The closed space is shown by a double chain line bs in FIG. 1, and is referred to as a close-enabled space "bs". Then, when the atmospheric valve 42 is opened, the pressure in the close-enabled space "bs" becomes substantially equal to the atmospheric pressure.

In a case in which the fuel vapor treating portion 52 presumes that an amount of the fuel vapor absorbed by the canister 30 reaches a predetermined amount or more, for example, when the engine 2 is driven, namely when the intake air flows in the intake passage 4, the fuel vapor treating portion 52 controls the operation of the purge valve 41 by using the control portion 51 and thereby the purge passage 22 is set to be opened. At this time, the atmospheric valve 42 is set to open the atmospheric passage 23. With this, negative pressure is generated on a side of the intake passage 4 in the purge passage 22. As a result, the fuel vapor absorbed by the absorbent 32 of the canister 30 and the fuel vapor in the space 33 are discharged (purged) into the intake passage 4 through the purge passage 22. In this way, the fuel vapor treating portion 52 can control the operation of the purge valve 41 by using the control portion 51 and can discharge the fuel vapor into the intake passage 4 and treats the fuel vapor.

The pressure sensor 61 is arranged, for example, in the purge passage member 220. The pressure sensor 61 detects the pressure in the purge passage 22 and outputs a signal corresponding to the detected pressure to the ECU 50. With this, the ECU 50 can detect the pressure in the purge passage 22. The pressure sensor 61 is arranged to be contacted with the canister 30 or to be adjacent to the canister 30. That is, the pressure sensor 61 is arranged at a one end side of the purge passage 22 and can detect the pressure in the purge passage 22 especially at the one end side. That is, the pressure sensor 61 is arranged to be able to detect the pressure in the close-enabled space "bs". The pressure sensor 61 is also deemed to be arranged to be able to detect the pressure in a space on an opposite side to the fuel tank 11 with respect to the specific part sp1.

The temperature sensor 62 is arranged, for example, at a bottom part of the fuel tank 11. The temperature sensor 62 detects a temperature of the fuel in the fuel tank 11 and outputs a signal corresponding to the detected temperature to the ECU 50. With this, the ECU 50 can detect the temperature of the fuel in the fuel tank 11.

The fuel level sensor 63 is arranged in the fuel pump 6. The fuel level sensor 63 has, for example, an arm having a bar shape, a float arranged at one end of the arm, a detection portion arranged at the other end of the arm and fixed to the fuel pump 6, and the like. The float is arranged to float on a liquid surface of the fuel, and thereby a position of the float in the vertical direction is changed in accordance with the amount of the fuel in the fuel tank 11. When the position of the float in the vertical direction is changed, a rotation position of the arm is changed. The detection portion outputs a signal corresponding to the rotation position of the arm to the ECU 50. That is, the fuel level sensor 63 detects the amount of the fuel in the fuel tank 11 and outputs the signal corresponding to the detected amount of the fuel to the ECU 50. With this, the ECU 50 can detect the amount of the fuel in the fuel tank 11.

In a case in which the purge valve 41 and the atmospheric valve 42 are set to be closed and the tank switch valve 43 is set to be opened when the temperature of the fuel in the fuel tank 11 is high, the pressure of an upper space 112, which is a space in the fuel tank 11 other than the fuel, and the close-enabled space "bs" is increased due to the fuel vapor generated in the fuel tank 11. A volume of the upper space 112 is small when the amount of the fuel in the fuel tank 11 is large, and the volume of the upper space 112 is large when the amount of the fuel in the fuel tank 11 is small. Thus, the pressure of the upper space 112 and the close-enabled space "bs" is increased quickly when the amount of the fuel in the fuel tank 11 is large, and the pressure of the upper space 112 and the close-enabled space "bs" is increased slowly when the amount of the fuel in the fuel tank 11 is small.

The purge valve 41 and the atmospheric valve 42 are set to be closed and the tank switch valve 43 is set to be opened when the temperature of the fuel in the fuel tank 11 is high. In this state, when a part of the tank passage 21 is clogged, each pressure of the upper space 112, a space between the fuel tank 11 and a clogged portion in the tank passage 21 and a space between the canister 30 and the clogged portion in the close-enabled space "bs" is increased at each speed.

The abnormality detection portion 54 can detect the clog abnormality, which is "an abnormality of the tank passage 21 being clogged", based on the signal from the pressure sensor 61 when the tank switch valve 43 is activated in a state in which the purge valve 41 and the atmospheric valve 42 are closed by executing the abnormality detection processing after the engine 2 is stopped.

In the present embodiment, when the pressure of the upper space 112 in the fuel tank 11 is increasing in a state in which the purge valve 41 and the atmospheric valve 42 are closed after the engine 2 is stopped, the clog abnormality can be detected by means of the abnormality detection processing.

In the present embodiment, the pressure sensor 61 is arranged to be able to detect the pressure in the purge passage 22, namely the pressure in the close-enabled space "bs". Thus, when the clog abnormality does not occur in the tank passage 21 and the tank switch valve 43 is activated to be closed in a state in which the purge valve 41 and the atmospheric valve 42 are closed in the abnormality detection processing, it is considered that a change rate of the pressure detected by the pressure sensor 61 is changed between the times before and after the tank switch valve 43 is closed. On the other hand, when the clog abnormality occurs in the tank passage 21 and the tank switch valve 43 is activated to be closed in a state in which the purge valve 41 and the atmospheric valve 42 are closed in the abnormality detection processing, it is considered that the change rate of the pressure detected by the pressure sensor 61 is not substantially changed between the times before and after the tank switch valve 43 is closed. Accordingly, in the abnormality detection processing, the abnormality detection portion 54 does not detect the clog abnormality of the tank passage 21 when the change rate of the pressure detected by pressure sensor 61 is changed between the times before and after the tank switch valve 43 is closed, and the abnormality detection portion 54 detects the clog abnormality of the tank passage 21 when the change rate of the pressure detected by the pressure sensor 61 is not substantially changed between the times before and after the tank switch valve 43 is closed.

More specifically, in the present embodiment, in the abnormality detection process, the abnormality detection portion 54 closes the tank switch valve 43 at a first time st1 that is a time when a first time period T1 has elapsed after opening the tank switch valve 43 and closing the purge valve 41 and the atmospheric valve 42. When a difference between "the change rate of the pressure detected by the pressure sensor 61 before the first time st1" and "the change rate of the pressure detected by the pressure sensor 61 after the first time st1" is less than a first predetermined value th1, the abnormality detection portion 54 detects the clog abnormality. That is, the abnormality detection portion 54 determines that "the clog abnormality occurs in the tank passage 21". On the other hand, when the difference between "the change rate of the pressure detected by the pressure sensor 61 before the first time st1" and "the change rate of the pressure detected by the pressure sensor 61 after the first time st1" is equal to or more than the first predetermined value th1, the abnormality detection portion 54 does not detect the clog abnormality, namely the abnormality detection portion 54 determines that "the clog abnormality does not occur in the tank passage 21".

The abnormality detection portion 54 sets the first time period T1 based on at least one of the amount of the fuel in the fuel tank 11 (the volume of the upper space 112), a kind of the fuel stored in the fuel tank 11, a temperature of the fuel in the fuel tank 11, and the atmospheric pressure. For example, the abnormality detection portion 54 sets the first time period T1 to be shorter as the amount of the fuel stored in the fuel tank 11 is larger. For example, when a kind of the fuel stored in the fuel tank 11 is for summer, the abnormality detection portion 54 sets the first time period T1 to be long, and when a kind of the fuel stored in the fuel tank 11 is for winter, the abnormality detection portion 54 sets the first time period T1 to be short. For example, the abnormality detection portion 54 sets the first time period T1 to be shorter as the temperature of the fuel in the fuel tank 11 is higher. For example, the abnormality detection portion 54 sets the first time period T1 to be longer as the atmospheric pressure is higher.

In the present embodiment, in the abnormality detection processing, the abnormality detection portion 54 opens the tank switch valve 43 at a second time st2 that is a time when a second time period T2 has elapsed after the first time period T1 has elapsed and the tank switch valve 43 is closed. When a difference between "the change rate of the pressure detected by the pressure sensor 61 before the second time st2" and "the change rate of the pressure detected by the pressure sensor 61 after the second time st2" is less than a second predetermined value th2, the abnormality detection portion 54 detects the clog abnormality. That is, the abnormality detection portion 54 determines that "the clog abnormality occurs in the tank passage 21". On the other hand, when the difference between "the change rate of the pressure detected by the pressure sensor 61 before the second time st2" and "the change rate of the pressure detected by the pressure sensor 61 after the second time st2" is equal to or more than the second predetermined value th2, the abnormality detection portion 54 does not detect the clog abnormality, namely the abnormality detection portion 54 determines that "the clog abnormality does not occur in the tank passage 21".

In the present embodiment, even if it is presumed that "the clog abnormality occurs in the tank passage 21" after the first time st1, in a case in which "the clog abnormality does not occur in the tank passage 21" is determined after the second time st2, the abnormality detection portion 54 does not detect the clog abnormality at last. In other words, the abnormality detection portion 54 determines that "the clog abnormality does not occur in the tank passage 21".

The abnormality detection portion 54 sets the second time period T2, similar to the first time period T1, based on at least one of the amount of the fuel in the fuel tank 11, a kind of the fuel stored in the fuel tank 11, the temperature of the fuel in the fuel tank 11, and the atmospheric pressure.

Figure 2:
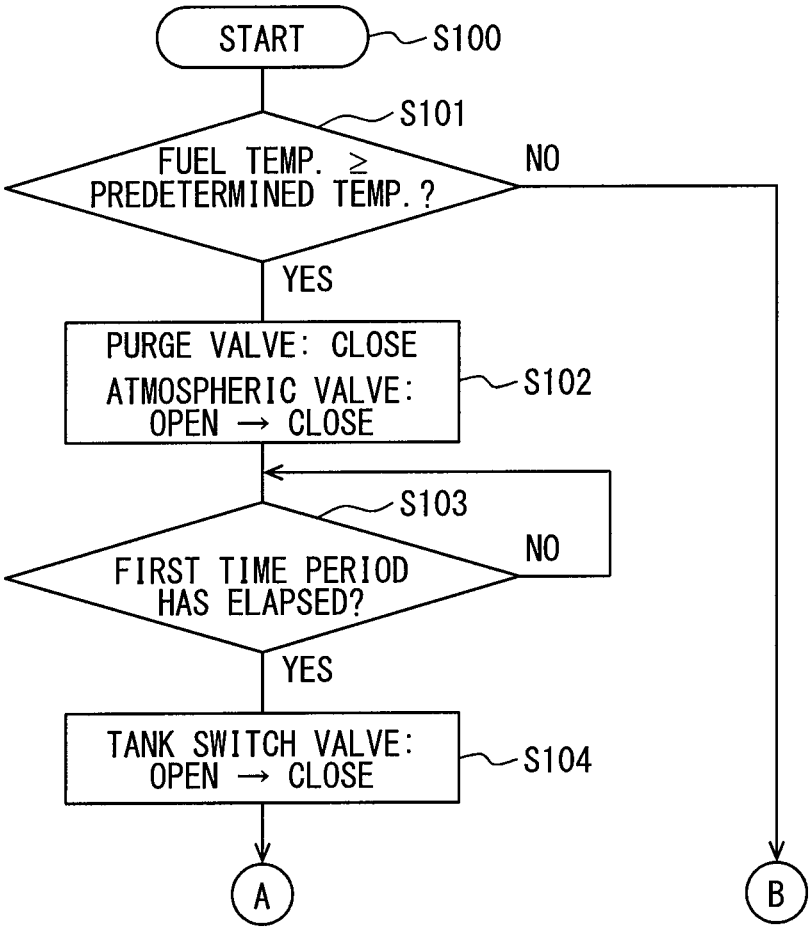
FIG. 2 is a flowchart illustrating a part of abnormality detection processing executed by the fuel vapor treatment system according to the first embodiment.
Figure 3:
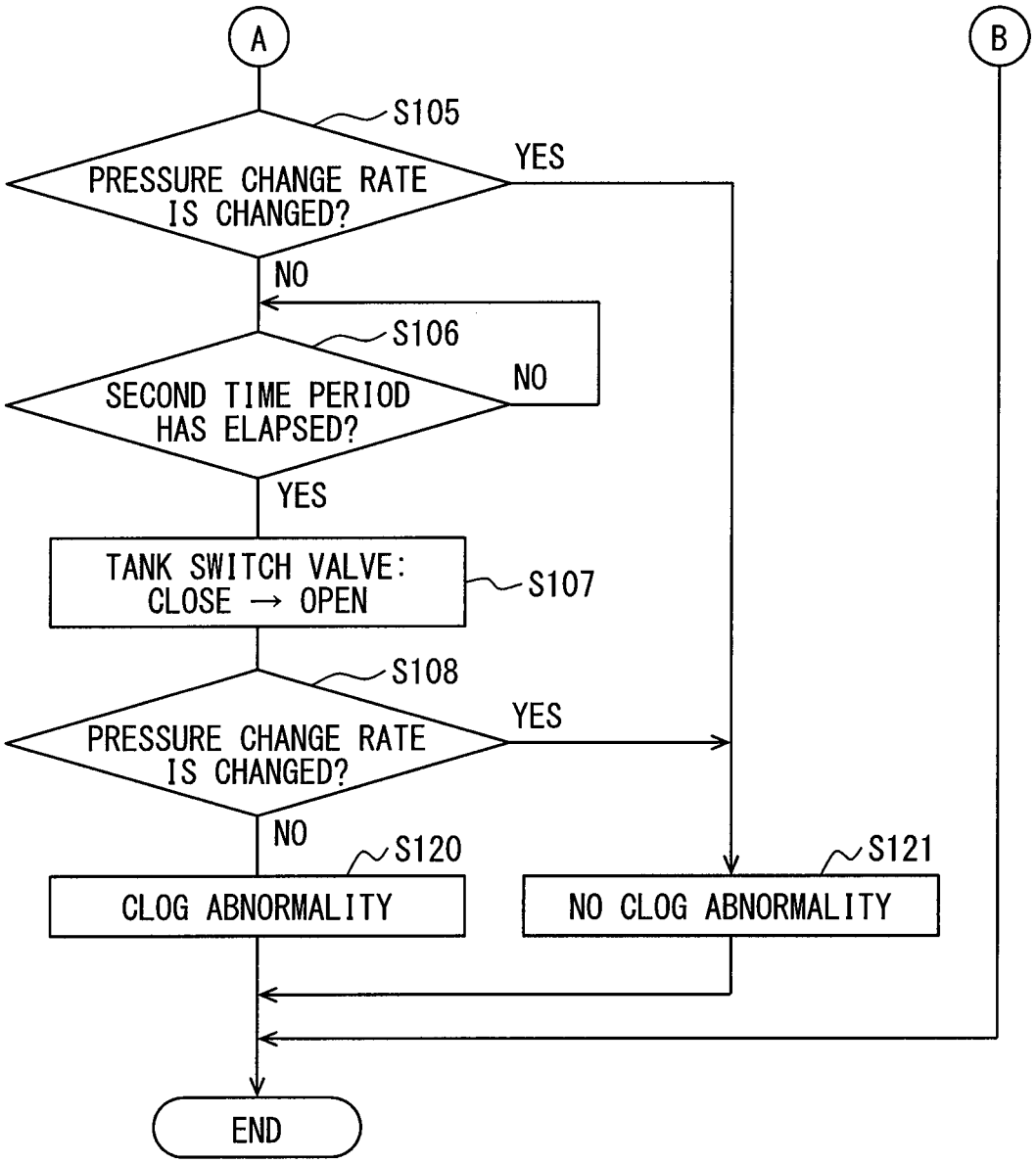
FIG. 3 is a flowchart illustrating a part of the abnormality detection processing executed by the fuel vapor treatment system according to the first embodiment.

Hereinafter, the abnormality detection processing executed by the ECU 50 is described with reference to FIGS. 2 and 3. In the present embodiment, a series of processing S100 shown in FIGS. 2 and 3 is started, for example, after an ignition key is turned off and the engine 2 is stopped.

In S101, the ECU 50 determines whether the temperature of the fuel in the fuel tank 11 is equal to or more than a predetermined temperature based on a signal from the temperature sensor 62. When the ECU 50 determines that the temperature of the fuel is equal to or more than the predetermined temperature (S101: YES), the procedure proceeds to S102. On the other hand, when the ECU 50 determines that the temperature of the fuel is less than the predetermined temperature (S101: NO), the procedure ends a series of the processing S100.

In S102, the ECU 50 closes the atmospheric valve 42 being opened. At this time, the purge valve 41 is set to be closed. After that, the procedure proceeds to S103.

In S103, the ECU 50 determines whether the first time period T1 has elapsed after the atmospheric valve 42 is closed in S102. When the ECU 50 determines that the first time period T1 has elapsed (S103: YES), the procedure proceeds to S104. On the other hand, when the ECU 50 determines that the first time period T1 has not elapsed (S103: NO), the procedure returns to S103. That is, S103 is repeatedly executed until the first time period T1 has elapsed since the atmospheric valve 42 is closed in S102.

In S104, the ECU 50 closes the tank switch valve 43 being opened (the first time st1). After that, the procedure proceeds to S105.

In S105, the ECU 50 determines whether the change rate of the pressure detected by the pressure sensor 61 is changed between the times before and after the first time st1 when the tank switch valve 43 is closed in S104.

Specifically, when the difference between "the change rate of the pressure detected by the pressure sensor 61 before the first time st1" and "the change rate of the pressure detected by the pressure sensor 61 after the first time st1" is less than the first predetermined valve th1, the ECU 50 determines that "the change rate of the pressure is not changed". On the other hand, when the difference between "the change rate of the pressure detected by the pressure sensor 61 before the first time st1" and "the change rate of the pressure detected by the pressure sensor 61 after the first time st1" is equal to or more than the first predetermined value th1, the ECU 50 determines that "the change rate of the pressure is changed".

When the ECU 50 determines that "the change rate of the pressure is not changed" (S105: NO), it is presumed that "the clog abnormality occurs in the tank passage 21" and the procedure proceeds to S106. On the other hand, when the ECU 50 determines that "the change rate of the pressure is changed" (S105: YES), the procedure proceeds to S121.

In S106, the ECU 50 determines whether the second time period T2 has elapsed after the tank switch valve 43 is closed in S104. When the ECU 50 determines that the second time period T2 has elapsed (S106: YES), the procedure proceeds to S107. On the other hand, when the ECU 50 determines that the second time period T2 is not elapsed (S106: NO), the procedure returns to S106. That is, S106 is repeatedly executed until the second time period T2 has elapsed after the tank switch valve 43 is closed in S104.

In S107, the ECU 50 opens the tank switch valve 43 being closed (the second time st2). After that, the procedure proceeds to S108.

In S108, the ECU 50 determines whether the change rate of the pressure detected by the pressure sensor 61 is changed between the times before and after the second time st2 when the tank switch valve 43 is opened in S107.

Specifically, when the difference between "the change rate of the pressure detected by the pressure sensor 61 before the second time st2" and "the change rate of the pressure detected by the pressure sensor 61 after the second time st2" is less than the second predetermined value th2, the ECU 50 determines that "the change rate of the pressure is not changed". On the other hand, when the difference between "the change rate of the pressure detected by the pressure sensor 61 before the second time st2" and "the change rate of the pressure detected by the pressure sensor 61 after the second time st2" is equal to or more than the second predetermined value th2, the ECU 50 determines that "the change rate of the pressure is changed".

When the ECU 50 determines that "the change rate of the pressure is not changed" (S108: NO), the procedure proceeds to S120. On the other hand, when the ECU 50 determines that "the change rate of the pressure is changed" (S108: YES), the procedure proceeds to S121.

In S120, the ECU 50 detects the clog abnormality, namely the ECU 50 determines that "the clog abnormality occurs in the tank passage 21". In a case in which the ECU 50 detects the clog abnormality, the ECU 50 informs a driver that "the clog abnormality occurs in the tank passage 21", for example, by turning on a warning light or the like of a display device arranged in front of a driver seat of the vehicle 1. After that the procedure ends a series of the processing S100.

In S121, the ECU 50 does not detect the clog abnormality, namely the ECU 50 determines that "the clog abnormality does not occur in the tank passage 21". After that, the procedure ends a series of the processing S100.

In this way, the ECU 50 functions as the abnormality detection portion 54 in a series of the processing S100, and therefore executes the abnormality detection processing (S102 to S108, S120, and S121).

Next, an operation example relating to the abnormality detection processing of the fuel vapor treatment system 10 according to the present embodiment is described with reference to FIG. 4.

At first, an operation example when the clog abnormality occurs in the tank passage 21 (abnormal condition) is described. A change of the pressure in the purge passage 22 detected by the pressure sensor 61 at this time is shown by a chain line in a graph illustrating a relationship between the times and the pressure in FIG. 4. Here, the specific part sp1 of the tank passage 21 is clogged.

When the engine 2 is stopped at a time t1, the ECU 50 starts S100. At this time, the atmospheric valve 42 is opened, and therefore the pressure in the purge passage 22 is equal to the atmospheric pressure.

In a case in which the ECU 50 determines that "the temperature of the fuel in the fuel tank 11 is equal to or more than the predetermined temperature" at a time t2, the ECU 50 closes the atmospheric valve 42 being opened. In this example (the chain line shown in FIG. 4), the specific part sp1 is clogged, and therefore when the atmospheric valve 42 is closed, a space on a side of the canister 30 is sealed against the specific part sp1 (the clog part) in the close-enabled space "bs". Thus, the pressure in the purge passage 22 detected by the pressure sensor 61 is increased after the time t2.

The ECU 50 closes the tank switch valve 43 being opened when the first time period T1 has elapsed since the time t2 (first time st1: time t4).

When a predetermined time period has elapsed since the time t4 (time t5), the ECU 50 determines whether the change rate of the pressure detected by the pressure sensor 61 is changed between the times before and after the time t4 when the tank switch valve 43 is closed.

Specifically, when the difference between "the change rate of the pressure detected by the pressure sensor 61 before the time t4" and "the change rate of the pressure detected by the pressure sensor 61 after the time t4" is less than the first predetermined value th1, the ECU 50 determines that "the change rate of the pressure is not changed". On the other hand, when the difference between "the change rate of the pressure detected by the pressure sensor 61 before the time t4" and "the change rate of the pressure detected by the pressure sensor 61 after the time t4" is equal to or more than the first predetermined value th1, the ECU 50 determines that "the change rate of the pressure is changed".

More specifically, it is assumed that "a differential pressure (absolute value) between the pressure detected by the pressure sensor 61 at the time t4 and the pressure detected by the pressure sensor 61 at the time t3 that is before the time t4 by a predetermined time period" is defined as Δp01, "a differential pressure (absolute value) between the pressure detected by the pressure sensor 61 at the time t4 and the pressure detected by the pressure sensor 61 at the time t5 that is after the time t4 by a predetermined time period" is defined as Δp02, and the predetermined time is set to be t4−t3=t5−t4. Then, the ECU 50 determines whether the change rate of the pressure is changed by comparing a difference between Δp01 and Δp02 with the first predetermined value th1.

In this example (the chain line shown in FIG. 4), the difference between Δp01 and Δp02 is less than the first predetermined value th1, and therefore the ECU 50 determines that "the change rate of the pressure is not changed".

The ECU 50 opens the tank switch valve 43 being closed when the second time period T2 has elapsed since the time t4 when the tank switch valve 43 is closed (second time st2: time t7).

When a predetermined time period has elapsed since the time t7 (time t8), the ECU 50 determines whether the change rate of the pressure detected by the pressure sensor 61 is changed between the times before and after the time t7 when the tank switch valve 43 is opened.

Specifically, when the difference between "the change rate of the pressure detected by the pressure sensor 61 before the time t7" and "the change rate of the pressure detected by the pressure sensor 61 after the time t7" is less than the second predetermined value th2, the ECU 50 determines that "the change rate of the pressure is not changed". On the other hand, when the difference between "the change rate of the pressure detected by the pressure sensor 61 before the time t7" and "the change rate of the pressure detected by the pressure sensor 61 after the time t7" is equal to or more than the second predetermined value th2, the ECU 50 determines that "the change rate of the pressure is changed".

More specifically, it is assumed that "a differential pressure (absolute value) between the pressure detected by the pressure sensor 61 at the time t7 and the pressure detected by the pressure sensor 61 at the time t6 that is before the time t7 by a predetermined time period" is defined as Δp03, "a differential pressure (absolute value) between the pressure detected by the pressure sensor 61 at the time t7 and the pressure detected by the pressure sensor 61 at the time t8 that is after the time t7 by a predetermined time period" is defined as Δp04, and the predetermined time is set to be t7−t6=t8−t7. Then, the ECU 50 determines whether the change rate of the pressure is changed by comparing a difference between Δp03 and Δp04 with the second predetermined value th2.

In this example (the chain line shown in FIG. 4), the difference between Δp03 and Δp04 is less than the second predetermined value th2, and therefore the ECU 50 determines that "the change rate of the pressure is not changed". Thus, the ECU 50 detects the clog abnormality, namely the ECU 50 determines that "the clog abnormality occurs in the tank passage 21". The ECU 50 informs a driver that "the clog abnormality occurs in the tank passage 21", for example, by turning on a warning light or the like of a display device arranged in front of a driver seat of the vehicle 1. After that, the ECU 50 ends S100.

Next, an operation example when the clog abnormality does not occur in the tank passage 21 (normal condition) is described. A change of the pressure in the purge passage 22 detected by the pressure sensor 61 at this time is shown by a continuous line in the graph illustrating the relationship between the times and the pressure in FIG. 4.

Since the operation until the time t4 is similar to that in the abnormal condition (the chain line shown in FIG. 4), the description thereof is omitted.

When a predetermined time period has elapsed since the time t4 (time t5), the ECU 50 determines whether the change rate of the pressure detected by the pressure sensor 61 is changed between the times before and after the time t4 when the tank switch valve 43 is closed.

Specifically, when the difference between "the change rate of the pressure detected by the pressure sensor 61 before the time t4" and "the change rate of the pressure detected by the pressure sensor 61 after the time t4" is less than the first predetermined value th1, the ECU 50 determines that "the change rate of the pressure is not changed". On the other hand, when the difference between "the change rate of the pressure detected by the pressure sensor 61 before the time t4" and "the change rate of the pressure detected by the pressure sensor 61 after the time t4" is equal to or more than the first predetermined value th1, the ECU 50 determines that "the change rate of the pressure is changed".

More specifically, it is assumed that "a differential pressure (absolute value) between the pressure detected by the pressure sensor 61 at the time t4 and the pressure detected by the pressure sensor 61 at the time t3 that is before the time t4 by a predetermined time period" is defined as Δp11, "a differential pressure (absolute value) between the pressure detected by the pressure sensor 61 at the time t4 and the pressure detected by the pressure sensor 61 at the time t5 that is after the time t4 by a predetermined time period" is defined as Δp12, and the predetermined time is set to be t4−t3=t5−t4. Then, the ECU 50 determines whether the change rate of the pressure is changed by comparing a difference between Δp11 and Δp12 with the first predetermined value th1.

In this example (the continuous line shown in FIG. 4), the difference between Δp11 and Δp12 is equal to or more than the first predetermined value th1, and therefore the ECU 50 determines that "the change rate of the pressure is changed". Thus, the ECU 50 does not detect the clog abnormality, namely the ECU 50 determines that "the clog abnormality does not occur in the tank passage 21 (normal)". After that, the ECU 50 ends S100.

In this example (the continuous line shown in FIG. 4), the ECU 50 opens the tank switch valve 43 being closed when the second time period T2 has elapsed since the time t4 when the tank switch valve 43 is closed (second time st2: time t7).

It is assumed that "a differential pressure (absolute value) between the pressure at the time t7 and the pressure at the time t6 that is before the time t7 by a predetermined time period" is defined as Δp13, "a differential pressure (absolute value) between the pressure at the time t7 and the pressure at the time t8 that is after the time t7 by a predetermined time period" is defined as Δp14, and the predetermined time is set to be t7−t6=t8−t7. Then, a difference between Δp13 and Δp14 is equal to or more than the second predetermined value th2.

Figure 4:
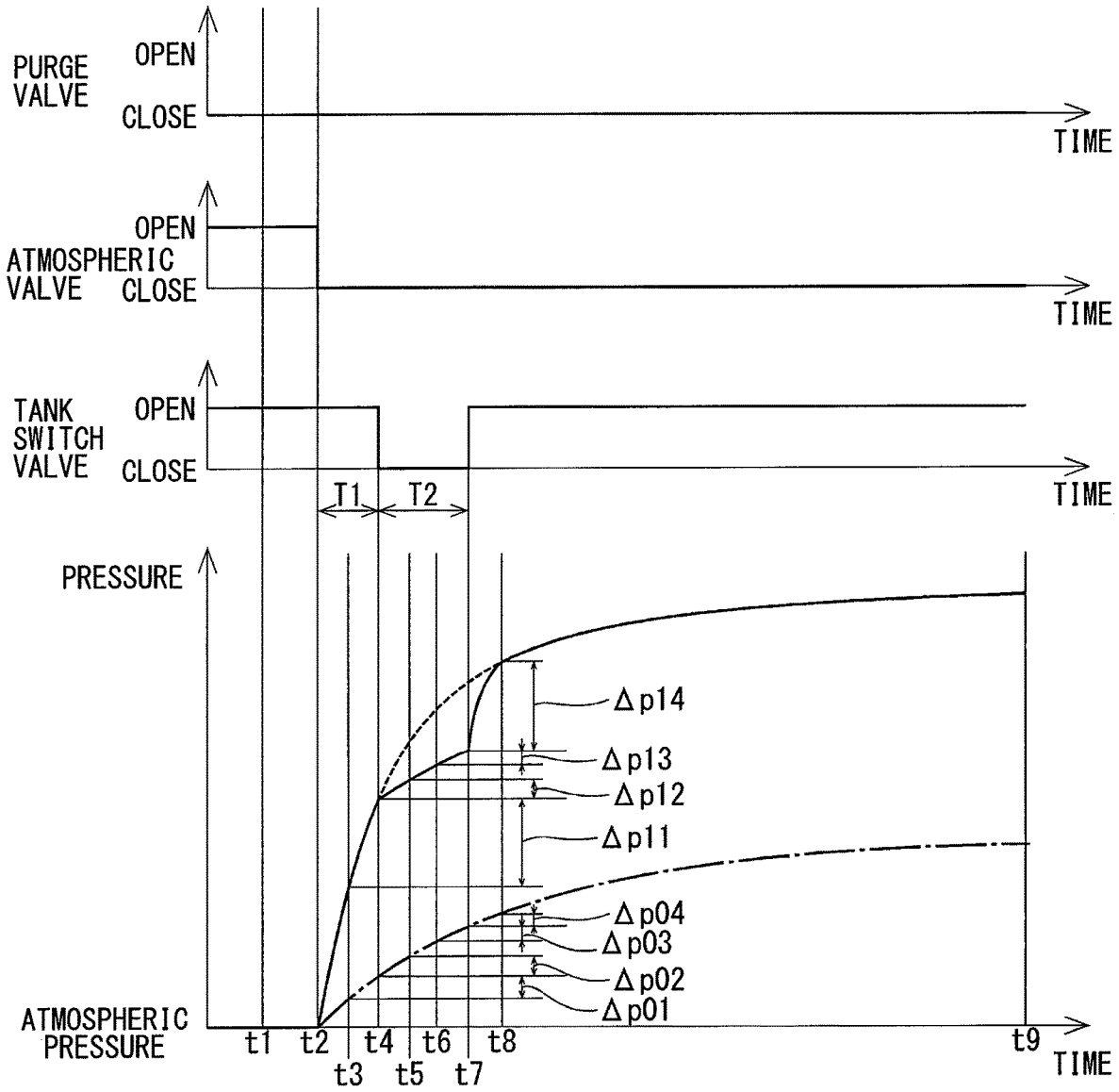
FIG. 4 is a view for explaining an operation example of the fuel vapor treatment system according to the first embodiment, in which an operation state of each valve and a change of the pressure in accordance with the elapsed time are illustrated.

The change of the pressure shown by a dashed line in the graph illustrating the relationship between the times and the pressure in FIG. 4 is an example of a configuration in which the tank switch valve 43 is kept to be opened when the clog abnormality does not occur in the tank passage 21 (normal condition) or the tank switch valve 43 is not arranged.

The time when the temperature of the fuel in the fuel tank 11 and the pressure in the purge passage 22 become the maximum is defined as a time t9, and after the time t9, the temperature of the fuel in the fuel tank 11 and the pressure in the purge passage 22 are decreased.

Figure 5:
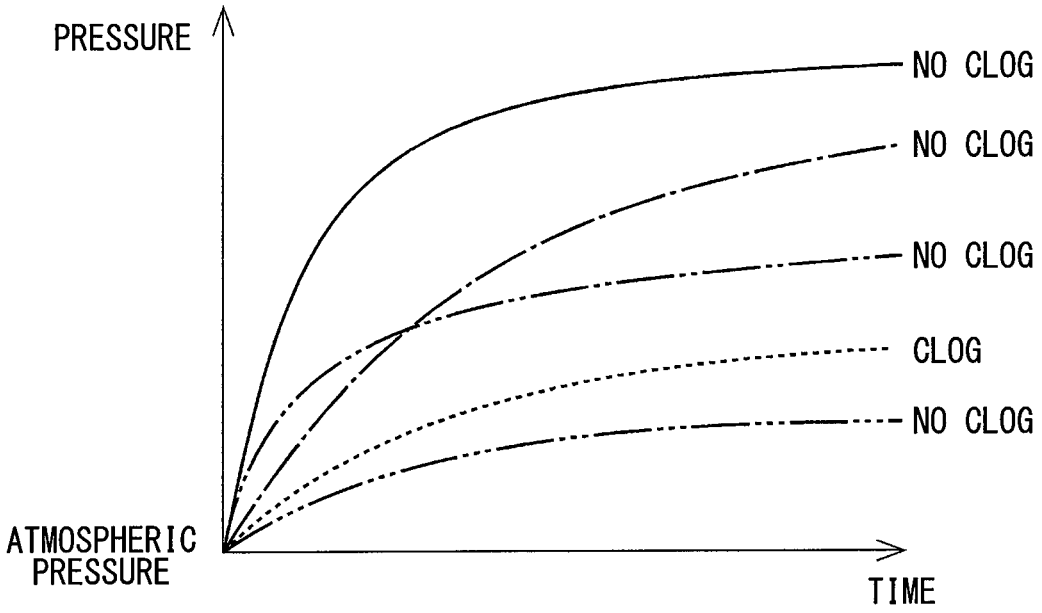
FIG. 5 is a view illustrating the change of the pressure in accordance with the elapsed time in a state in which the purge valve and the atmospheric valve are closed and the tank switch valve is opened after the internal combustion engine is stopped.

As shown in FIG. 5, when the purge valve 41 and the atmospheric valve 42 are kept to be closed and the tank switch valve 43 is kept to be opened after the engine 2 is stopped, there are various changes of the pressure detected by the pressure sensor 61 in accordance with the elapsed time due to the amount of the fuel in the fuel tank 11 (the volume of the upper space 112), a kind of the fuel stored in the fuel tank 11, the temperature of the fuel in the fuel tank 11, or the atmospheric pressure. In the graph in FIG. 5, it is difficult to distinguish a case in which the tank passage 21 is clogged (a dashed line shown in FIG. 5) and a case in which the tank passage 21 is not clogged (a continuous line, a chain line, a two-dot chain line, and a three-dot chain line shown in FIG. 5).

In the present embodiment, as described above, the occurrence of the clog abnormality of the tank passage 21 can be detected by opening and closing the tank switch valve 43 when the pressure in the purge passage 22 is increased in a state in which the purge valve 41 and the atmospheric valve 42 are closed.

As described above, in the present embodiment, the fuel vapor treatment system 10 is capable of discharging the fuel vapor generated from the fuel evaporated in the fuel tank 11 into the intake passage 4 of the engine 2 of the vehicle 1 and capable of processing the fuel vapor. The fuel vapor treatment system 10 includes the tank passage 21, the canister 30, the purge passage 22, the atmospheric passage 23, the tank switch valve 43, the purge valve 41, the atmospheric valve 42, the pressure sensor 61, and the abnormality detection portion 54.

One end of the tank passage 21 is connected to the fuel tank 11.

The canister 30 is connected to the other end of the tank passage 21 and can absorb the fuel vapor generated in the fuel tank 11.

One end of the purge passage 22 is connected to the canister 30, and the other end of the purge passage 22 is connected to the intake passage 4.

One end of the atmospheric passage 23 is connected to the canister 30, and the other end of the atmospheric passage 23 is connected to the atmosphere.

The purge valve 41 can open and close the purge passage 22.

The atmospheric valve 42 can open and close the atmospheric passage 23.

The tank switch valve 43 can open and close the tank passage 21.

The pressure sensor 61 detects pressure in the purge passage 22 and outputs a signal corresponding to the detected pressure.

The abnormality detection portion 54 executes abnormality detection processing that can detect the clog abnormality, which is "the abnormality in which the tank passage 21 is clogged", based on the signal from the pressure sensor 61 when the tank switch valve 43 is activated in a state in which the purge valve 41 and the atmospheric valve 42 are closed, after driving of the engine 2 is stopped.

In the present embodiment, when the clog abnormality does not occur in the tank passage 21 and the tank switch valve 43 is activated to be closed in a state in which the purge valve 41 and the atmospheric valve 42 are closed in the abnormality detection processing, it is considered that the change rate of the pressure detected by the pressure sensor 61 is changed between the times before and after the tank switch valve 43 is closed. On the other hand, when the clog abnormality occurs in the tank passage 21 and the tank switch valve 43 is activated to be closed in a state in which the purge valve 41 and the atmospheric valve 42 are closed in the abnormality detection processing, it is considered that the change rate of the pressure detected by the pressure sensor 61 is not substantially changed between the times before and after the tank switch valve 43 is closed. Accordingly, the abnormality detection portion 54 detects the clog abnormality when the change rate of the pressure detected by the pressure sensor 61 is not substantially changed between the times before and after the tank switch valve 43 is closed in the abnormality detection processing.

In this way, the present embodiment further includes the tank switch valve 43 compared to the conventional technique, and therefore the present embodiment can detect the clog abnormality based on the signal from the pressure sensor 61 when the tank switch valve 43 is activated in the abnormality detection processing.

In the present embodiment, the pressure sensor 61 is arranged to be able to detect the pressure of the close-enabled space "bs", which is the space on the side of the canister 30 with respect to the tank switch valve 43, the purge valve 41, and the atmospheric valve 42 among the space in the tank passage 21, the canister 30, the purge passage 22, and the atmospheric passage 23. Thus, when the clog abnormality occurs in the close-enabled space "bs" in the tank passage 21, the clog abnormality can be detected.

In the present embodiment, the abnormality detection portion 54 executes the abnormality detection processing (S102 to S108, S120, and S121) when the temperature of the fuel in the fuel tank 11 is equal to or more than the predetermined temperature. Thus, erroneous detection of the clog abnormality can be suppressed.

In the present embodiment, in the abnormality detection process, the abnormality detection portion 54 closes the tank switch valve 43 at the first time st1 that is the time when the first time period T1 has elapsed after opening the tank switch valve 43 and closing the purge valve 41 and the atmospheric valve 42. When the difference between "the change rate of the pressure detected by the pressure sensor 61 before the first time st1" and "the change rate of the pressure detected by the pressure sensor 61 after the first time st1" is less than the first predetermined value th1, the abnormality detection portion 54 detects the clog abnormality. When the difference between "the change rate of the pressure detected by the pressure sensor 61 before the first time st1" and "the change rate of the pressure detected by the pressure sensor 61 after the first time st1" is equal to or more than the first predetermined value th1, the abnormality detection portion 54 does not detect the clog abnormality (the abnormality detection portion 54 determines that it is normal).

In the present embodiment, the abnormality detection portion 54 sets the first time period T1 based on at least one of the amount of the fuel in the fuel tank 11, a kind of the fuel stored in the fuel tank 11, the temperature of the fuel in the fuel tank 11, and the atmospheric pressure. Thus, the abnormality detection portion 54 can execute the determination of the clog abnormality at a time when the change of the pressure is large (see FIG. 5). Accordingly, detection accuracy of the clog abnormality can be improved.

In the present embodiment, in the abnormality detection processing, the abnormality detection portion 54 opens the tank switch valve 43 at the second time st2 that is the time when the second time period T2 has elapsed after closing the tank switch valve 43 when the first time period T1 has elapsed. When the difference between "the change rate of the pressure detected by the pressure sensor 61 before the second time st2" and "the change rate of the pressure detected by the pressure sensor 61 after the second time st2" is less than the second predetermined value th2, the abnormality detection portion 54 detects the clog abnormality. When the difference between "the change rate of the pressure detected by the pressure sensor 61 before the second time st2" and "the change rate of the pressure detected by the pressure sensor 61 after the second time st2" is equal to or more than the second predetermined value th2, the abnormality detection portion 54 does not detect the clog abnormality (the abnormality detection portion 54 determines that it is normal).

In the present embodiment, in the abnormality detection processing, the clog abnormality is attempted to be detected when the tank switch valve 43 is closed, and after that, the clog abnormality is also attempted to be detected when the tank switch valve 43 is opened. Thus, the detection accuracy of the clog abnormality can be improved.

In the present embodiment, even if the occurrence of the clog abnormality is presumed when the tank switch valve 43 is closed (S105: YES), after that, in a case in which the clog abnormality is not detected when the tank switch valve 43 is opened (S108: NO), the clog abnormality is not detected at last. In other words, it is determined that "the clog abnormality does not occur in the tank passage 21 (it is normal)". Thus, the erroneous detection of the clog abnormality can be suppressed.

In the present embodiment, the tank passage 21 has the specific part sp1 located lower than the horizontal planes hp1, hp2, which pass the one end and the other end of the tank passage 21 respectively, in the vertical direction in a state in which tank passage 21 is mounted in the vehicle 1. The liquefied fuel vapor or a foreign substance is apt to be retained at the specific part sp1, and thereby the tank passage 21 might be clogged at the specific part sp1. Thus, the present embodiment is suitable to the fuel vapor treatment system provided with the tank passage 21 having such a configuration.

In the present embodiment, the pressure sensor 61 is arranged to be able to detect the pressure at the opposite side to the fuel tank 11 with respect to the specific part sp1. Thus, when the clog abnormality occurs in the specific part sp1 or a part on a side closer to the fuel tank 11 than the specific part sp1 in the tank passage 21, the clog abnormality can be detected.

In the present embodiment, the tank switch valve 43 is arranged on the side of the fuel tank 11 with respect to the specific part sp1. Thus, when the clog abnormality occurs in a part on the side of the specific part sp1 with respect to the tank switch valve 43 in the tank passage 21, the clog abnormality can be detected.

In the present embodiment, the tank switch valve 43 is arranged adjacent to the fuel tank 11. Thus, when the clog abnormality occurs in any part in the tank passage 21, the clog abnormality can be detected.

Second Embodiment

A fuel vapor treatment system according to a second embodiment of the present disclosure is described with reference to FIGS. 6 to 8. In the second embodiment, the abnormality detection processing executed by an ECU 50 is different from that of the first embodiment.

A physical configuration of the second embodiment is the same as that of the first embodiment.

Figure 6:
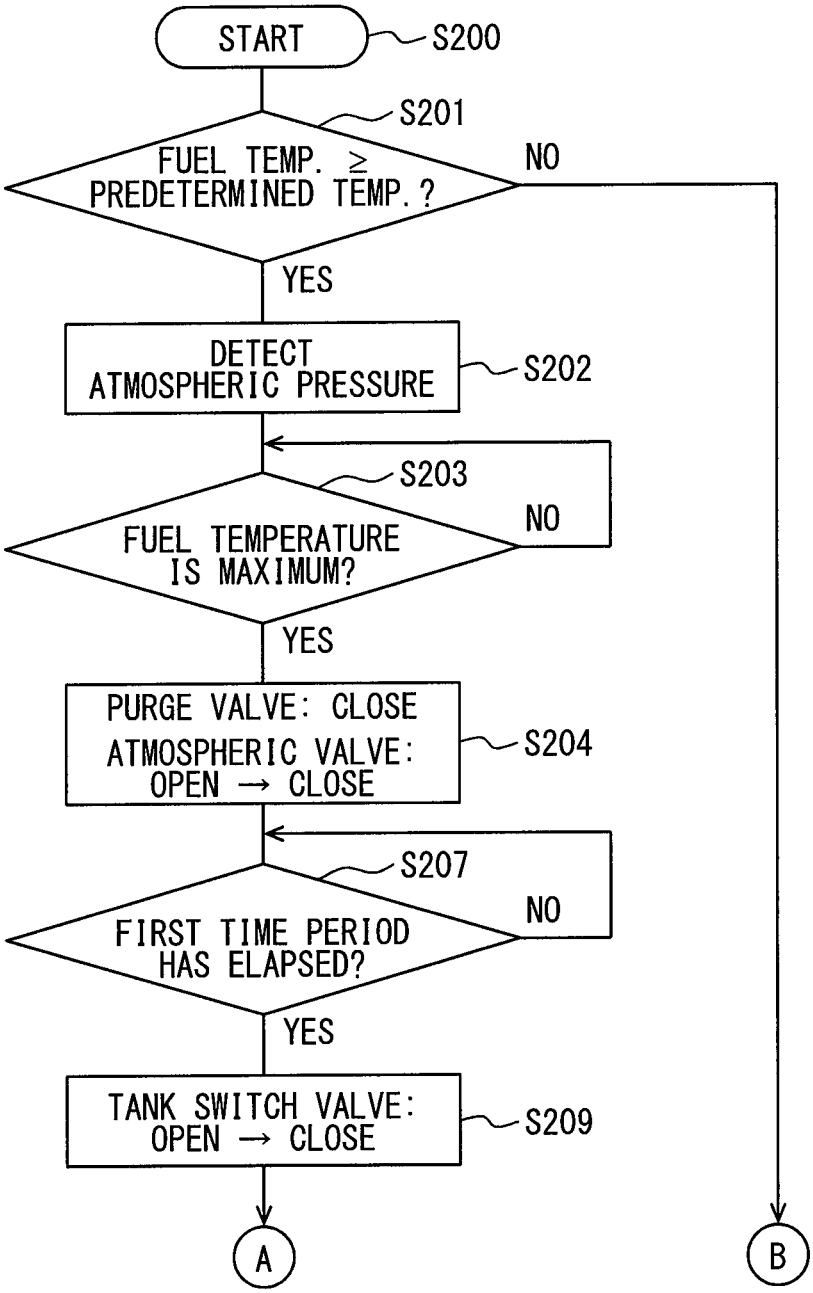
FIG. 6 is a flowchart illustrating a part of abnormality detection processing executed by a fuel vapor treatment system according to a second embodiment.
Figure 7:
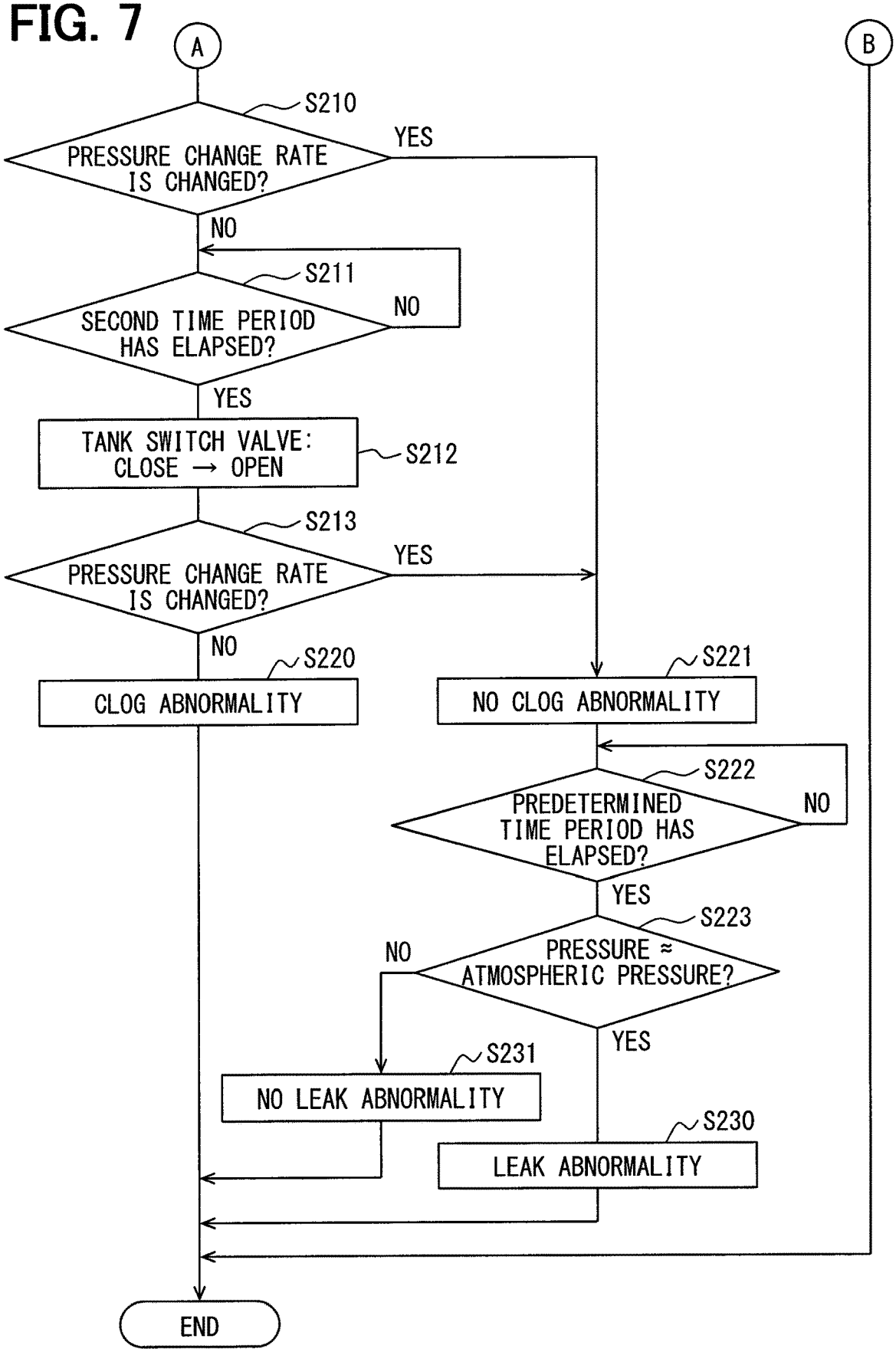
FIG. 7 is a flowchart illustrating a part of the abnormality detection processing executed by the fuel vapor treatment system according to the second embodiment.

FIGS. 6 and 7 show the abnormality detection processing executed by the ECU 50 according to the second embodiment.

In the present embodiment, a series of processing S200 shown in FIGS. 6 and 7 is similar to S100 shown in the first embodiment, and for example, S200 is started after the ignition key is turned off and the engine 2 is stopped.

In S201, the ECU 50 determines whether a temperature of fuel in the fuel tank 11 is equal to or more than a predetermined temperature based on a signal from the temperature sensor 62. When the ECU 50 determines that the temperature of the fuel is equal to or more than the predetermined temperature (S201: YES), the procedure proceeds to S202. On the other hand, when the ECU 50 determines that the temperature of the fuel is lower than the predetermined temperature (S201: NO), the procedure ends a series of the processing S200.

In S202, the ECU 50 detects the pressure in the purge passage 22 based on a signal from the pressure sensor 61. At this time, the purge valve 41 is closed and the atmospheric valve 42 is opened, and therefore the pressure in the purge passage 22 is equal to the atmospheric pressure. Thus, at this time, the ECU 50 detects the atmospheric pressure. The ECU 50 records the detected atmospheric pressure. After that, the procedure proceeds to S203.

In S203, the ECU 50 determines whether the temperature of the fuel in the fuel tank 11 becomes the maximum based on the signal from the temperature sensor 62. Specifically, the ECU 50 determines that the temperature of the fuel in the fuel tank 11 becomes the maximum when the increasing temperature is turned into decreasing. When the ECU 50 determines that the temperature of the fuel in the fuel tank 11 becomes the maximum (S203: YES), the procedure proceeds to S204. On the other hand, when the ECU 50 determines that the temperature of the fuel in the fuel tank 11 does not become the maximum (S203: NO), the procedure returns to S203. That is, S203 is repeatedly executed until the temperature of the fuel in the fuel tank 11 becomes the maximum.

In S204, the ECU 50 closes the atmospheric valve 42 being opened. At this time, the purge valve 41 is closed. Since the temperature of the fuel in the fuel tank 11 is decreased after the temperature becomes the maximum in S203, the pressure in the purge passage 22 is decreased in a range lower than the atmospheric pressure after the atmospheric valve 42 is closed in S204. After S204, the procedure proceeds to S207.

In S207, the ECU 50 determines whether a first time period T1 has elapsed after the atmospheric valve 42 is closed in S204. When the ECU 50 determines that the first time period T1 has elapsed (S207: YES), the procedure proceeds to S209. On the other hand, when the ECU 50 determines that the first time period T1 is not elapsed (S207: NO), the procedure returns to S207. That is, S207 is repeatedly executed until the first time period T1 has elapsed after the atmospheric valve 42 is closed in S204.

In S209, the ECU 50 closes the tank switch valve 43 being opened (first time st1). After that, the procedure proceeds to S210.

In S210, the ECU 50 determines whether a change rate of the pressure detected by the pressure sensor 61 is changed between the times before and after the first time st1 when the tank switch valve 43 is closed in S209.

Specifically, when the difference between "the change rate of the pressure detected by the pressure sensor 61 before the first time st1" and "the change rate of the pressure detected by the pressure sensor 61 after the first time st1" is less than the first predetermined valve th1, the ECU 50 determines that "the change rate of the pressure is not changed". On the other hand, when the difference between "the change rate of the pressure detected by the pressure sensor 61 before the first time st1" and "the change rate of the pressure detected by the pressure sensor 61 after the first time st1" is equal to or more than the first predetermined value th1, the ECU 50 determines that "the change rate of the pressure is changed".

When the ECU 50 determines that "the change rate of the pressure is not changed" (S210: NO), the procedure proceeds to S211. On the other hand, when the ECU 50 determines that "the change rate of the pressure is changed" (S210: YES), the procedure proceeds to S221.

In S211, the ECU 50 determines whether the second time period T2 has elapsed after the tank switch valve 43 is closed in S209. When the ECU 50 determines that the second time period T2 has elapsed (S211: YES), the procedure proceeds to S212. On the other hand, when the ECU 50 determines that the second time period T2 is not elapsed (S211: NO), the procedure returns to S211. That is, S211 is repeatedly executed until the second time period T2 has elapsed after the tank switch valve 43 is closed in S209.

In S212, the ECU 50 opens the tank switch valve 43 being closed (second time st2). After that, the procedure proceeds to S213.

In S213, the ECU 50 determines whether the change rate of the pressure detected by the pressure sensor 61 is changed between the times before and after the second time st2 when the tank switch valve 43 is opened in S212.

Specifically, when the difference between "the change rate of the pressure detected by the pressure sensor 61 before the second time st2" and "the change rate of the pressure detected by the pressure sensor 61 after the second time st2" is less than the second predetermined value th2, the ECU 50 determines that "the change rate of the pressure is not changed". On the other hand, when the difference between "the change rate of the pressure detected by the pressure sensor 61 before the second time st2" and "the change rate of the pressure detected by the pressure sensor 61 after the second time st2" is equal to or more than the second predetermined value th2, the ECU 50 determines that "the change rate of the pressure is changed".

When the ECU 50 determines that "the change rate of the pressure is not changed" (S213: NO), the procedure proceeds to S220. On the other hand, when the ECU 50 determines that "the change rate of the pressure is changed" (S213: YES), the procedure proceeds to S221.

In S220, the ECU 50 detects the clog abnormality, namely the ECU 50 determines that "the clog abnormality occurs in the tank passage 21". When the ECU 50 detects the clog abnormality, the ECU 50 informs a driver that "the clog abnormality occurs in the tank passage 21", for example, by turning on a warning light or the like of a display device arranged in front of a driver seat of the vehicle 1. After that the procedure ends a series of the processing S200.

In S221, the ECU 50 does not detect the clog abnormality, namely the ECU 50 determines that "the clog abnormality does not occur in the tank passage 21". After that, the procedure proceeds to S222.

In S222, the ECU 50 determines whether a predetermined time period has elapsed since the ECU 50 determines that "the clog abnormality does not occur in the tank passage 21" in S221. When the ECU 50 determines that the predetermined time period has elapsed (S222: YES), the procedure proceeds to S223. On the other hand, when the ECU 50 determines that the predetermined time period is not elapsed (S222: NO), the procedure returns to S222. That is, S222 is repeatedly executed until the predetermined time period has elapsed since the ECU 50 determines that "the clog abnormality does not occur in the tank passage 21" in S221.

In S223, the ECU 50 determines whether the pressure detected by the pressure sensor 61 is equal to the atmospheric pressure. Specifically, when a difference between the pressure detected by the pressure sensor 61 and the atmospheric pressure detected in S202 is less than a predetermined value, the ECU 50 determines that the detected pressure is equal to the atmospheric pressure. When the ECU 50 determines that the detected pressure is equal to the atmospheric pressure (S223: YES), the procedure proceeds to S230. On the other hand, when the ECU 50 determines that the detected pressure is not equal to the atmospheric pressure (S223: NO), the procedure proceeds to S231.

In S230, the ECU 50 detects a leak abnormality that is an abnormality of leakage of the fuel vapor from the fuel tank 11, the tank passage 21, the canister 30, the purge passage 22 or the atmospheric passage 23 to an outside. When the ECU 50 detects the leak abnormality, the ECU 50 informs a driver that "the leak abnormality occurs in the tank passage 21", for example, by turning on a warning light or the like of a display device arranged in front of a driver seat of the vehicle 1. After that, the procedure ends a series of the processing S200.

In S231, the ECU 50 does not detect the leak abnormality, namely the ECU 50 determines that "the leak abnormality does not occur (it is normal)". After that, the procedure ends a series of the processing S200.

In this way, the ECU 50 functions as an abnormality detection portion 54 in a series of the processing S200 and executes the abnormality detection processing (S202 to S213, S220 to S223, S230, and S231). When the ECU 50 does not detect the clog abnormality (S221), the leak abnormality can be detected in S222, S223, S230, and S231.

As described above, in the present embodiment, when the abnormality detection portion 54 does not detect the clog abnormality in the abnormality detection processing, the abnormality detection portion 54 can detect the leak abnormality that is "the abnormality of leakage of the fuel vapor from the fuel tank 11, the tank passage 21, the canister 30, the purge passage 22 or the atmospheric passage 23 to an outside" by comparing the pressure detected by the pressure sensor 61 with the atmospheric pressure.

Specifically, the abnormality detection portion 54 determines whether the pressure detected by the pressure sensor 61 is equal to or lower than the atmospheric pressure after a predetermined time period has elapsed since the abnormality detection portion 54 determines that "the clog abnormality does not occur". When the abnormality detection portion 54 determines that the pressure detected by the pressure sensor 61 is equal to the atmospheric pressure, the abnormality detection portion 54 detects the leak abnormality. On the other hand, when the abnormality detection portion 54 determines that the pressure detected by the pressure sensor 61 is lower than the atmospheric pressure, the abnormality detection portion 54 determines that it is normal without detecting the leak abnormality.

In this way, in the present embodiment, the abnormality detection portion 54 can also detect the leak abnormality of the fuel vapor in addition to the clog abnormality of the tank passage 21.

Next, an operation example of the abnormality detection processing of the fuel vapor treatment system 10 according to the present embodiment is described with reference to FIG. 8.

At first, an operation example when the clog abnormality occurs in the tank passage 21 (abnormal condition) is described. A change of the pressure in the purge passage 22 detected by the pressure sensor 61 at this time is shown by a chain line in a graph illustrating a relationship between the times and the pressure in FIG. 8. Here, the specific part sp1 of the tank passage 21 is clogged and the leak abnormality does not occur.

When the engine 2 is stopped at a time t1, the ECU 50 starts S200. At this time, the atmospheric valve 42 is opened, and therefore the pressure in the purge passage 22 is equal to the atmospheric pressure. When the ECU 50 determines that "the temperature of the fuel in the fuel tank 11 is equal to or more than the predetermined temperature", the ECU 50 detects the pressure in the purge passage 22, namely the atmospheric pressure based on the signal from the pressure sensor 61.

When the ECU 50 determines that "the temperature of the fuel in the fuel tank 11 becomes the maximum" at a time t2, the ECU 50 closes the atmospheric valve 42 being opened. In this example (a chain line shown in FIG. 8), the specific part sp1 is clogged, and therefore when the atmospheric valve 42 is closed, a space on a side of the canister 30 is sealed against the specific part sp1 (the clog part) in a close-enabled space "bs". Thus, the pressure in the purge passage 22 detected by the pressure sensor 61 is decreased after the time t2.

The ECU 50 closes the tank switch valve 43 being opened when the first time period T1 has elapsed from the time t2 (first time st1: time t4).

When a predetermined time period has elapsed from the time t4 (time t5), the ECU 50 determines whether the change rate of the pressure detected by the pressure sensor 61 is changed between the times before and after the time t4 when the tank switch valve 43 is closed.

Specifically, when the difference between "the change rate of the pressure detected by the pressure sensor 61 before the time t4" and "the change rate of the pressure detected by the pressure sensor 61 after the time t4" is less than the first predetermined value th1, the ECU 50 determines that "the change rate of the pressure is not changed". On the other hand, when the difference between "the change rate of the pressure detected by the pressure sensor 61 before the time t4" and "the change rate of the pressure detected by the pressure sensor 61 after the time t4" is equal to or more than the first predetermined value th1, the ECU 50 determines that "the change rate of the pressure is changed".

More specifically, it is assumed that "a differential pressure (absolute value) between the pressure detected by the pressure sensor 61 at the time t4 and the pressure detected by the pressure sensor 61 at the time t3 that is before the time t4 by a predetermined time period" is defined as Δp01, "a differential pressure (absolute value) between the pressure detected by the pressure sensor 61 at the time t4 and the pressure detected by the pressure sensor 61 at the time t5 that is after the time t4 by a predetermined time period" is defined as Δp02, and the predetermined time is set to be t4−t3=t5−t4. Then, the ECU 50 determines whether the change rate of the pressure is changed by comparing a difference between Δp01 and Δp02 with the first predetermined value th1.

In this example (the chain line shown in FIG. 8), the difference between Δp01 and Δp02 is less than the first predetermined value th1, and therefore the ECU 50 determines that "the change rate of the pressure is not changed".

The ECU 50 opens the tank switch valve 43 being closed when the second time period T2 has elapsed since the time t4 when the tank switch valve 43 is closed (second time st2: time t7).

When a predetermined time period has elapsed since the time t7 (time t8), the ECU 50 determines whether the change rate of the pressure detected by the pressure sensor 61 is changed between the times before and after the time t7 when the tank switch valve 43 is opened.

Specifically, when the difference between "the change rate of the pressure detected by the pressure sensor 61 before the time t7" and "the change rate of the pressure detected by the pressure sensor 61 after the time t7" is less than the second predetermined value th2, the ECU 50 determines that "the change rate of the pressure is not changed". On the other hand, when the difference between "the change rate of the pressure detected by the pressure sensor 61 before the time t7" and "the change rate of the pressure detected by the pressure sensor 61 after the time t7" is equal to or more than the second predetermined value th2, the ECU 50 determines that "the change rate of the pressure is changed".

More specifically, it is assumed that "a differential pressure (absolute value) between the pressure detected by the pressure sensor 61 at the time t7 and the pressure detected by the pressure sensor 61 at the time t6 that is before the time t7 by a predetermined time period" is defined as Δp03, "a differential pressure (absolute value) between the pressure detected by the pressure sensor 61 at the time t7 and the pressure detected by the pressure sensor 61 at the time t8 that is after the time t7 by a predetermined time period" is defined as Δp04, and the predetermined time is set to be t7−t6=t8−t7. Then, the ECU 50 determines whether the change rate of the pressure is changed by comparing a difference between Δp03 and Δp04 with the second predetermined value th2.

In this example (the chain line shown in FIG. 8), the difference between Δp03 and Δp04 is less than the second predetermined value th2, and therefore the ECU 50 determines that "the change rate of the pressure is not changed". Thus, the ECU 50 detects the clog abnormality, namely the ECU 50 determines that "the clog abnormality occurs in the tank passage 21". The ECU 50 informs a driver that "the clog abnormality occurs in the tank passage 21", for example, by turning on a warning light or the like of a display device arranged in front of a driver seat of the vehicle 1. After that, the ECU 50 ends S200.

Next, an operation example when the clog abnormality does not occur in the tank passage 21 (normal condition) is described. The change of the pressure in the purge passage 22 detected by the pressure sensor 61 at this time is shown by a continuous line in the graph illustrating the relationship between the times and the pressure in FIG. 8. Note that the leakage abnormality does not occur at this time.

Since the operation until the time t4 is similar to that in the abnormal condition (the chain line shown in FIG. 8), the description thereof is omitted.

When a predetermined time period has elapsed from the time t4 (time t5), the ECU 50 determines whether the change rate of the pressure detected by the pressure sensor 61 is changed between the times before and after the time t4 when the tank switch valve 43 is closed.

Specifically, when the difference between "the change rate of the pressure detected by the pressure sensor 61 before the time t4" and "the change rate of the pressure detected by the pressure sensor 61 after the time t4" is less than the first predetermined value th1, the ECU 50 determines that "the change rate of the pressure is not changed". On the other hand, when the difference between "the change rate of the pressure detected by the pressure sensor 61 before the time t4" and "the change rate of the pressure detected by the pressure sensor 61 after the time t4" is equal to or more than the first predetermined value th1, the ECU 50 determines that "the change rate of the pressure is changed".

More specifically, it is assumed that "a differential pressure (absolute value) between the pressure detected by the pressure sensor 61 at the time t4 and the pressure detected by the pressure sensor 61 at the time t3 that is before the time t4 by a predetermined time period" is defined as Δp11, "a differential pressure (absolute value) between the pressure detected by the pressure sensor 61 at the time t4 and the pressure detected by the pressure sensor 61 at the time t5 that is after the time t4 by a predetermined time period" is defined as Δp12, and the predetermined time is set to be t4−t3=t5−t4. Then, the ECU 50 determines whether the change rate of the pressure is changed by comparing a difference between Δp11 and Δp12 with the first predetermined value th1.

In this example (the continuous line shown in FIG. 8), the difference between Δp11 and Δp12 is equal to or more than the first predetermined value th1, and therefore the ECU 50 determines that "the change rate of the pressure is changed". Thus, the ECU 50 does not detect the clog abnormality, namely the ECU 50 determines that "the clog abnormality does not occur in the tank passage 21 (normal)". After that, the procedure proceeds to S222 and it is attempted to detect the occurrence of the leak abnormality.

In this example (the continuous line shown in FIG. 8), the ECU 50 opens the tank switch valve 43 being closed when the second time period T2 has elapsed since the time t4 when the tank switch valve 43 is closed (second time st2: time t7).

It is assumed that "a differential pressure (absolute value) between the pressure at the time t7 and the pressure at the time t6 that is before the time t7 by a predetermined time period" is defined as Δp13, and "a differential pressure (absolute value) between the pressure at the time t7 and the pressure at the time t8 that is after the time t7 by a predetermined time period" is defined as Δp14, and the predetermined time is set to be t7−t6=t8−t7. Then, a difference between Δp13 and Δp14 is equal to or more than the second predetermined value th2.

Figure 8:
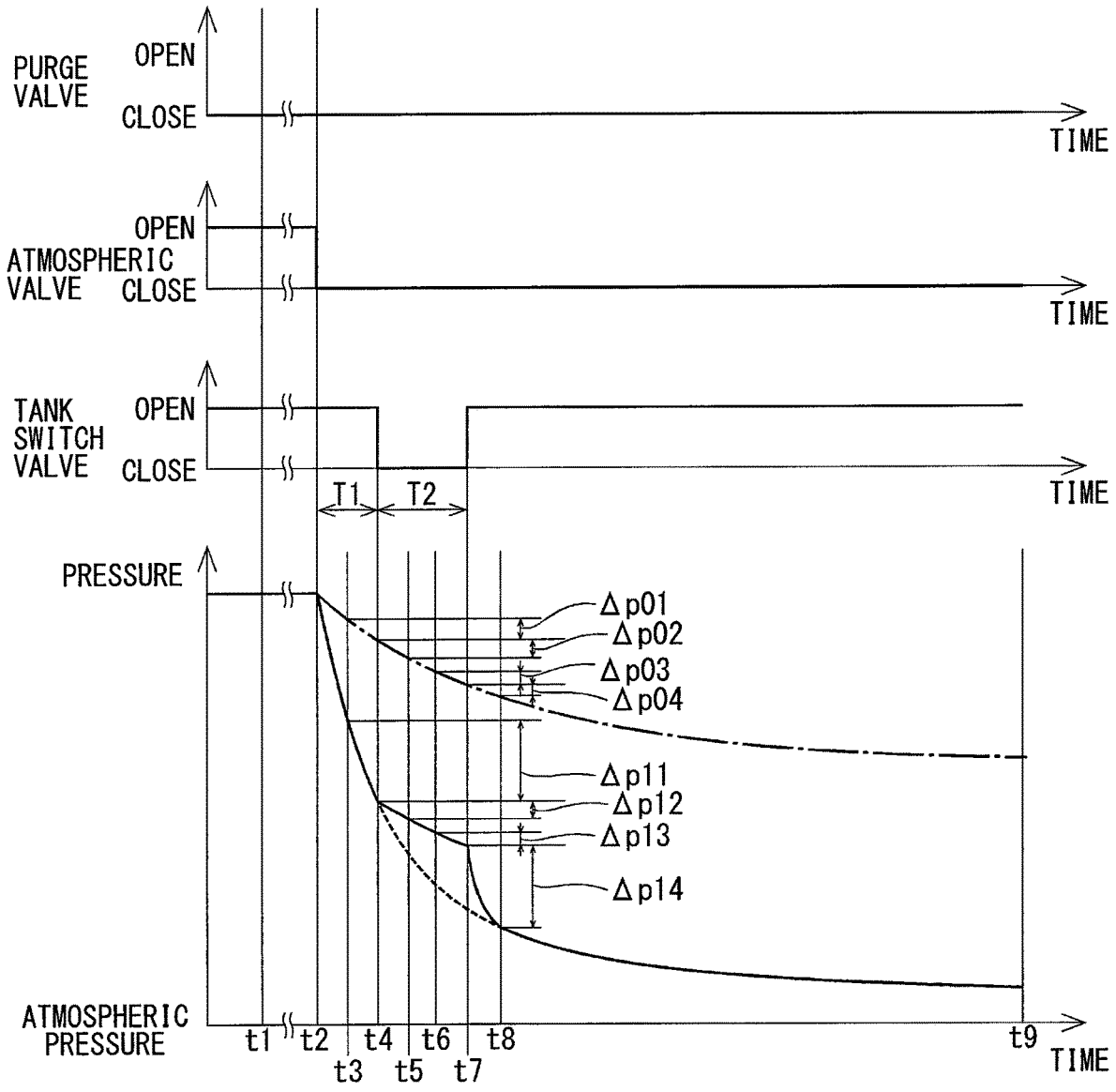
FIG. 8 is a view for explaining an operation example of the fuel vapor treatment system according to the second embodiment, in which an operation state of each valve and a change of the pressure in accordance with the elapsed time are illustrated.

The change of the pressure shown by a dashed line in the graph illustrating the relationship between the times and the pressure in FIG. 8 is an example of a configuration in which the tank switch valve 43 is kept to be opened when the clog abnormality does not occur in the tank passage 21 (normal condition) or the tank switch valve 43 is not arranged.

The time when the temperature of the fuel in the fuel tank 11 and the pressure in the purge passage 22 become the minimum is defined as a time t9, and after the time t9, each of the temperature of the fuel in the fuel tank 11 and the pressure in the purge passage 22 is constant.

In the present embodiment, as described above, the occurrence of the clog abnormality of the tank passage 21 can be detected by opening and closing the tank switch valve 43 when the pressure in the purge passage 22 is decreased in a state in which the purge valve 41 and the atmospheric valve 42 are closed.

In the present embodiment, when the ECU 50 does not detect the clog abnormality (S221), the leak abnormality can be detected in S222, S223, S230, and S231.

As described above, in the present embodiment, when the abnormality detection portion 54 does not detect the clog abnormality in the abnormality detection processing, the abnormality detection portion 54 can detect the leak abnormality that is "the abnormality of leakage of the fuel vapor from the fuel tank 11, the tank passage 21, the canister 30, the purge passage 22 or the atmospheric passage 23 to an outside" by comparing the pressure detected by the pressure sensor 61 with the atmospheric pressure. That is, the abnormality detection portion 54 can also detect the leak abnormality of the fuel vapor in addition to the clog abnormality of the tank passage 21.

Third Embodiment

A fuel vapor treatment system according to a third embodiment of the present disclosure is described with reference to FIG. 9. In the third embodiment, the abnormality detection processing executed by the ECU 50 is different from that of the second embodiment.

A physical configuration of the third embodiment is the same as that of the second embodiment.

Figure 9:
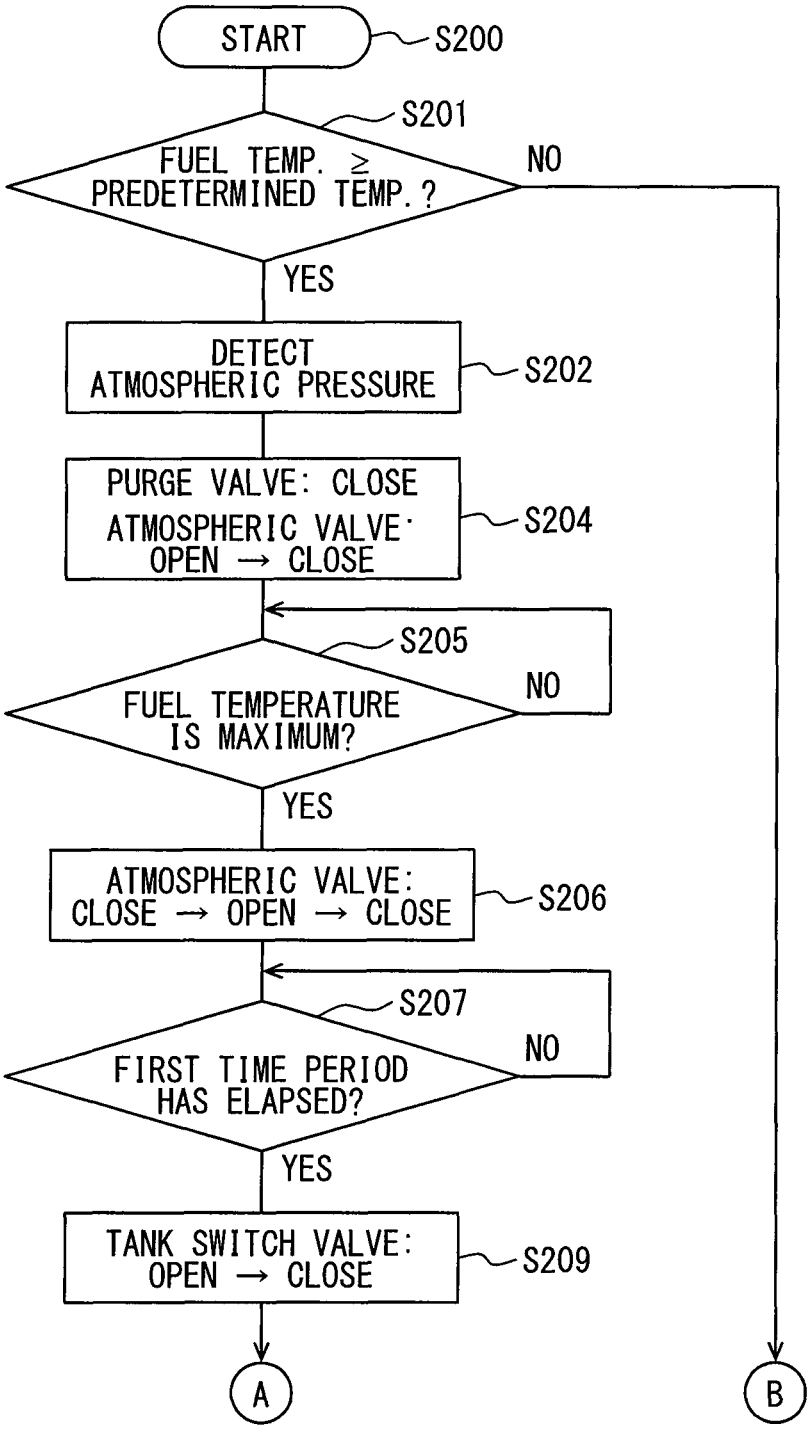
FIG. 9 is a flowchart illustrating a part of abnormality detection processing executed by a fuel vapor treatment system according to a third embodiment.

FIG. 9 shows a part (a first half) of the abnormality detection processing executed by the ECU 50 of the third embodiment.

In the present embodiment, S200 shown in FIG. 9 is similar to S200 shown in the second embodiment, and for example, S200 is started after the ignition key is turned off and the engine 2 is stopped.

The processing of S201 and S202 is the same as S201 and S202 in the second embodiment, and therefore the description thereof is omitted. In the present embodiment, after S202, the procedure proceeds to S204.

In S204, the ECU 50 closes the atmospheric valve 42 being opened. At this time, the purge valve 41 is closed. Thus, the pressure in the purge passage 22 is increased after the atmospheric valve 42 is closed. In the present embodiment, after S204, the procedure proceeds to S205.

In S205, the ECU 50 determines whether the pressure in the purge passage 22 becomes the maximum based on a signal from the pressure sensor 61. Specifically, the ECU 50 determines that the pressure in the purge passage 22 becomes the maximum when the increasing pressure is turned into decreasing. When the ECU 50 determines that the pressure in the purge passage 22 becomes the maximum (S205: YES), the procedure proceeds to S206. On the other hand, when the ECU 50 determines that the pressure in the purge passage 22 does not become the maximum (S205: NO), the procedure returns to S205. That is, S205 is repeatedly executed until the pressure in the purge passage 22 becomes the maximum.

In S206, the ECU 50 opens the atmospheric valve 42 being closed. With this, the pressure in the purge passage 22 becomes equal to the atmospheric pressure. After that, the ECU 50 closes the atmospheric valve 42 being opened. Since the pressure in the purge passage 22 is decreased after the pressure becomes the maximum in S205, the pressure in the purge passage 22 is decreased in a range lower than the atmospheric pressure after the atmospheric valve 42 is closed in S206. After S206, the procedure proceeds to S207.

In S207, the ECU 50 determines whether a first time period T1 has elapsed after the atmospheric valve 42 is closed in S206. When the ECU 50 determines that the first time period T1 has elapsed (S207: YES), the procedure proceeds to S209. On the other hand, when the ECU 50 determines that the first time period T1 is not elapsed (S207: NO), the procedure returns to S207. That is, S207 is repeatedly executed until the first time period T1 has elapsed after the atmospheric valve 42 is closed in S206.

In S209, the ECU 50 closes the tank switch valve 43 being opened (first time st1). After that, the procedure proceeds to S210.

The processing after S210 is the same as that in the second embodiment (see FIG. 7). In the present embodiment, in S223, the ECU 50 refers to the atmospheric pressure detected in S202. In the second embodiment, the timing when the pressure in the purge passage 22 is turned into decreasing is determined based on the change of the temperature of the fuel in the fuel tank 11 (S203), on the other hand, in the third embodiment, the timing when the pressure in the purge passage 22 is turned into decreasing is determined based on the change of the pressure in the purge passage 22 (S205).

Fourth Embodiment

A fuel vapor treatment system according to a fourth embodiment of the present disclosure is described with reference to FIG. 6. In the fourth embodiment, the abnormality detection processing executed by the ECU 50 is different from that of the first embodiment.

A physical configuration of the fourth embodiment is the same as that of the first embodiment.

Figure 10:
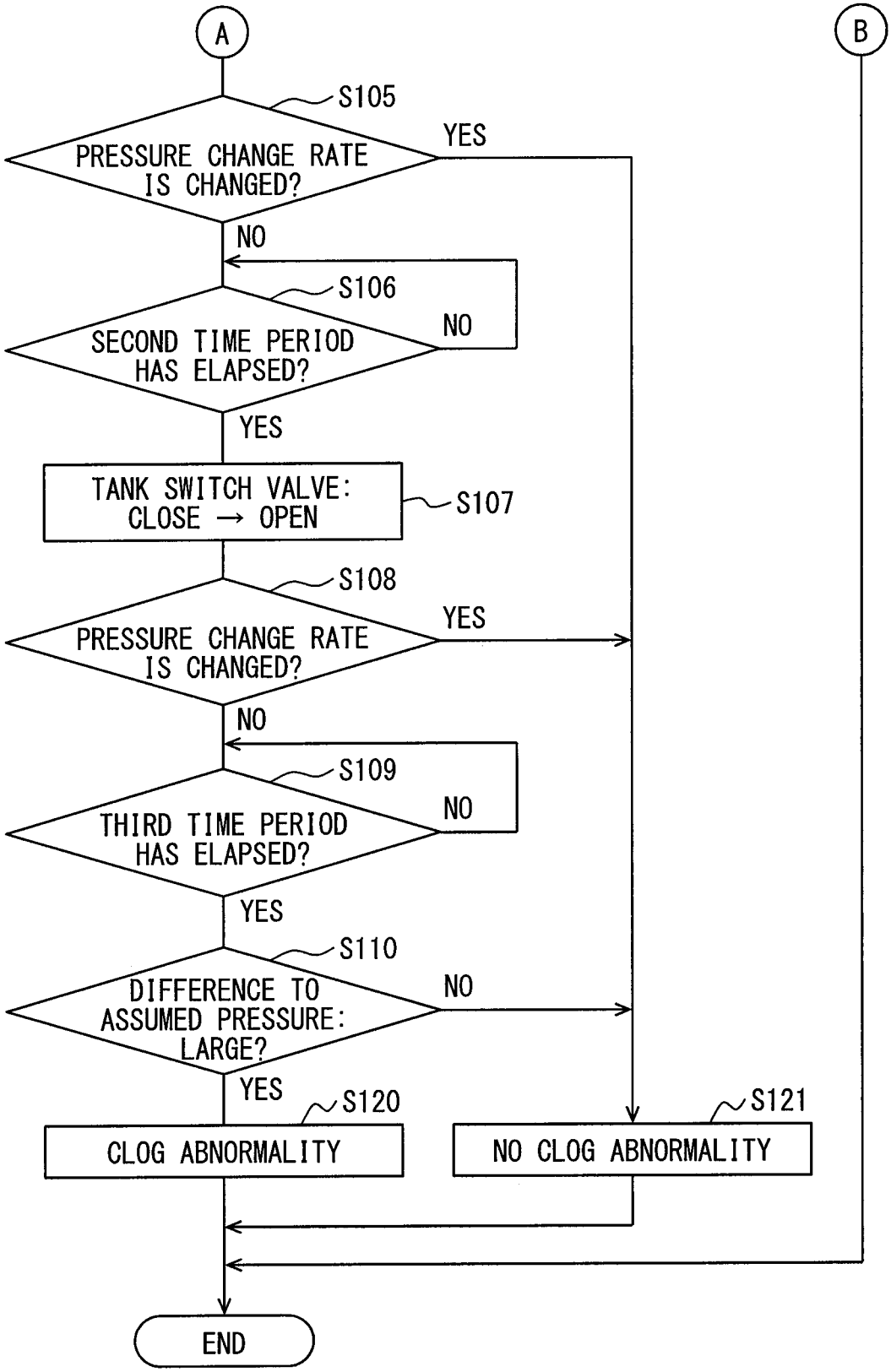
FIG. 10 is a flowchart illustrating a part of abnormality detection processing executed by a fuel vapor treatment system according to a fourth embodiment.

FIG. 10 shows a part (a latter half) of the abnormality detection processing executed by the ECU 50 of the fourth embodiment.

The processing of S101 to S108 is the same as that in the first embodiment, and therefore the description thereof is omitted.

In the present embodiment, when the ECU 50 determines that "the change rate of the pressure is not changed" in S108 (S108: NO), it is presumed that "the clog abnormality occurs in the tank passage 21" and the procedure proceeds to S109. On the other hand, when the ECU 50 determines that "the change rate of the pressure is changed" (S108: YES), the procedure proceeds to S121.

In S109, the ECU 50 determines whether a third time period T3 has elapsed after the second time period T2 elapsed since S104 (the first time st1) and then the tank switch valve 43 is opened in S107 (the second time st2) in the abnormality detection processing. When the ECU 50 determines that the third time period T3 has elapsed (S109: YES), the procedure proceeds to S110. On the other hand, when the ECU 50 determines that the third time period T3 is not elapsed (S109: NO), the procedure returns to S109. That is, S109 is repeatedly executed until the third time period T3 has elapsed after the tank switch valve 43 is opened in S107.

In S110, the ECU 50 compares the pressure detected by the pressure sensor 61 with "assumed pressure that is pressure assumed when the clog abnormality does not occur". The assumed pressure denotes the pressure in the purge passage 22 assumed when the clog abnormality does not occur in the tank passage 21. Various patterns of the assumed pressure are assumed based on the amount of the fuel in the fuel tank 11 (the volume of the upper space 112), a kind of the fuel stored in the fuel tank 11, the temperature of the fuel in the fuel tank 11, or the atmospheric pressure. The assumed pressure corresponds to the pressure shown in FIG. 5 (the continuous line, the chain line, the two-dot chain line, and the three-dot chain line). The ECU 50 records a relationship between the amount of the fuel in the fuel tank 11 (the volume of the upper space 112), a kind of the fuel stored in the fuel tank 11, the temperature of the fuel in the fuel tank 11, or the atmospheric pressure, and the elapsed time and the assumed pressure.

The ECU 50 determines whether a difference between the pressure detected by the pressure sensor 61 and the assumed pressure is large by comparing the pressure detected by the pressure sensor 61 with the assumed pressure assumed based on the amount of the fuel in the fuel tank 11 (the volume of the upper space 112), a kind of the fuel stored in the fuel tank 11, the temperature of the fuel in the fuel tank 11, or the atmospheric pressure, and the elapsed time.

Specifically, when the difference between the pressure detected by the pressure sensor 61 and the assumed pressure is more than a third predetermined value th3, the ECU 50 determines that "the difference between the pressure detected by the pressure sensor 61 and the assumed pressure is large". On the other hand, when the difference between the pressure detected by the pressure sensor 61 and the assumed pressure is equal to or less than the third predetermined value th3, the ECU 50 determines that "the difference between the pressure detected by the pressure sensor 61 and the assumed pressure is not large (small)".

When the ECU 50 determines that "the difference between the pressure detected by the pressure sensor 61 and the assumed pressure is large" (S110: YES), the procedure proceeds to S120. On the other hand, when the ECU 50 determines that "the difference between the pressure detected by the pressure sensor 61 and the assumed pressure is not large" (S110: NO), the procedure proceeds to S121.

In S120, the ECU 50 detects the clog abnormality, namely the ECU 50 determines that "the clog abnormality occurs in the tank passage 21". When the ECU 50 detects the clog abnormality, the ECU 50 informs a driver that "the clog abnormality occurs in the tank passage 21", for example, by turning on a warning light or the like of a display device arranged in front of a driver seat of the vehicle 1. After that the procedure ends a series of the processing S100.

In S121, the ECU 50 does not detect the clog abnormality, namely the ECU 50 determines that "the clog abnormality does not occur in the tank passage 21". After that, the procedure ends a series of the processing S100.

In this way, in the present embodiment, when the ECU 50 determines that "the change rate of the pressure is not changed" in S108 (S108: NO), contrary to the first embodiment, the ECU 50 does not detects the clog abnormality right after S108, and when the ECU 50 determines that "the difference between the pressure detected by the pressure sensor 61 and the assumed pressure is large" in S110 (S110: YES), the ECU 50 detects the clog abnormality (S120).

In the present embodiment, when the ECU 50 determines that "the change rate of the pressure is not changed" in S108 (S108: NO), the occurrence of the clog abnormality is presumed, however in a case in which the ECU 50 determines that "the difference between the pressure detected by the pressure sensor 61 and the assumed pressure is not large" in S110 (S110: NO), the ECU 50 does not detect the clog abnormality.

As described above, in the present embodiment, in the abnormality detection processing, when the third time period T3 has elapsed after the second time period T2 has elapsed and the tank switch valve 43 is opened, the abnormality detection portion 54 compares the pressure detected by the pressure sensor 61 with "the assumed pressure assumed when the clog abnormality does not occur". When the difference between the pressure detected by the pressure sensor 61 and the assumed pressure is more than the third predetermined value th3, the abnormality detection portion 54 detects the clog abnormality. When the difference between the pressure detected by the pressure sensor 61 and the assumed pressure is equal to or less than the third predetermined value th3, the abnormality detection portion 54 does not detect the clog abnormality (the abnormality detection portion 54 determines that it is normal).

In the present embodiment, in the abnormality detection processing, it is attempted to detect the clog abnormality when the tank switch valve 43 is closed, and after that, it is also attempted to detect the clog abnormality when the tank switch valve 43 is opened, and after that, it is further attempted to detect the clog abnormality by comparing the detected pressure and the assumed pressure. Thus, the detection accuracy of the clog abnormality can be further improved.

In the present embodiment, even if the occurrence of the clog abnormality is presumed when the tank switch valve 43 is closed (S105: YES) and after that, the occurrence of the clog abnormality is presumed when the tank switch valve 43 is opened (S108: YES), in a case in which the clog abnormality is not detected when the detected pressure and the assumed pressure are compared (S110: NO), the ECU 50 does not detect the clog abnormality. In other words, the ECU 50 determines that "the clog abnormality does not occur in the tank passage 21 (it is normal)". Thus, the erroneous detection of the clog abnormality can be suppressed.

Fifth Embodiment

Figure 11:
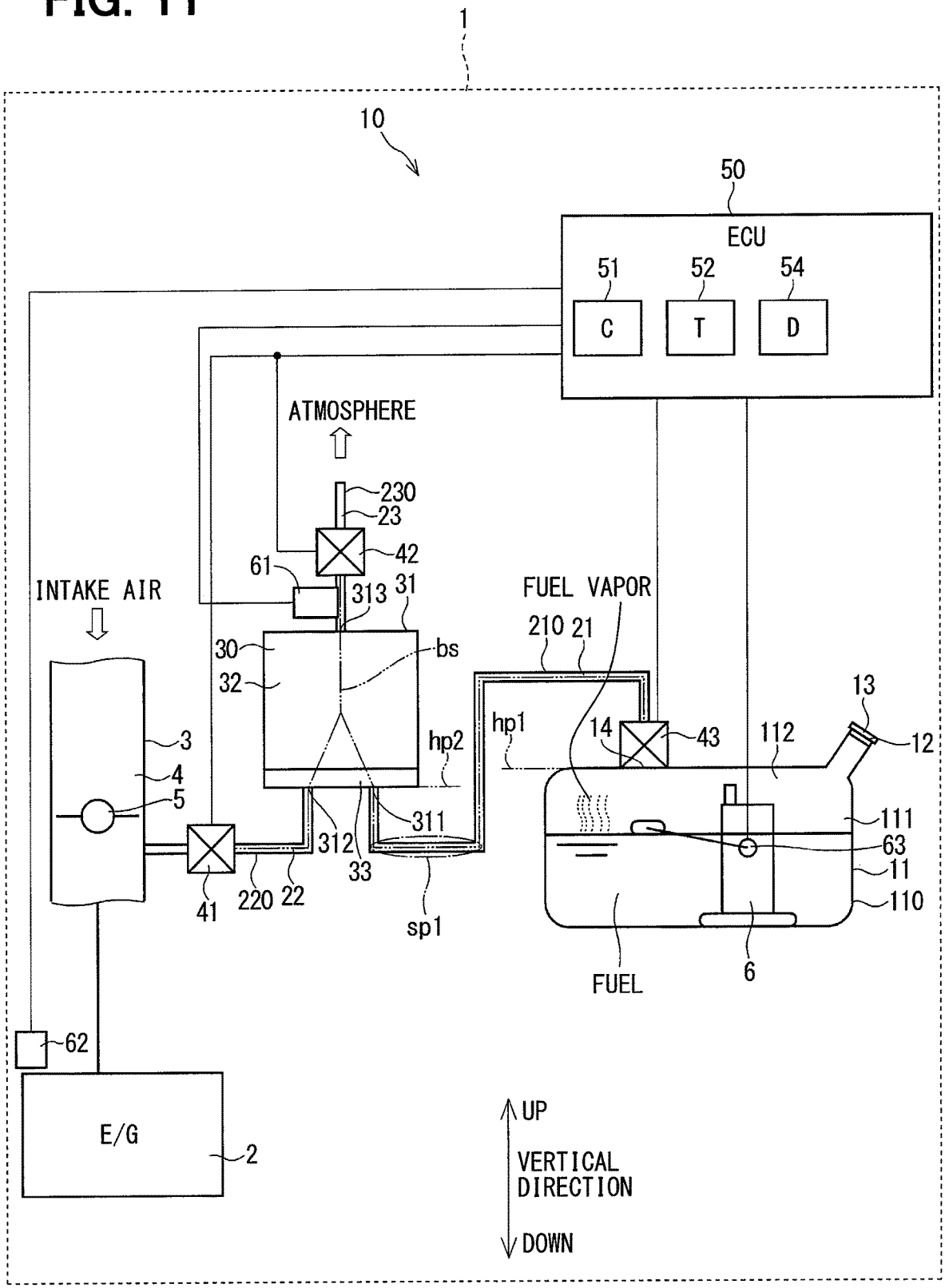
FIG. 11 is a schematic view illustrating a fuel vapor treatment system according to a fifth embodiment.

FIG. 11 shows a fuel vapor treatment system according to a fifth embodiment of the present disclosure. In the fifth embodiment, an arrangement of the pressure sensor 61 and the temperature sensor 62 is different from that of the first embodiment. An illustration of the vertical direction in FIG. 11 is applied to the fuel tank 11 and the tank passage 21 similar to FIG. 1. That is, for example, the canister 30 is mounted and arranged in the vehicle 1 regardless of the illustration of the vertical direction in FIG. 11.

In the fifth embodiment, the pressure sensor 61 is arranged, for example, in the atmospheric passage member 230. The pressure sensor 61 detects the pressure in the atmospheric passage 23 and outputs a signal corresponding to the detected pressure to the ECU 50. With this, the ECU 50 can detect the pressure in the atmospheric passage 23. The pressure sensor 61 is arranged to be able to detect the pressure in the close-enabled space "bs". The pressure sensor 61 is also deemed to be arranged to be able to detect the pressure in a space on an opposite side to the fuel tank 11 with respect to the specific part sp1.

The temperature sensor 62 detects a temperature of cooling water of the engine 2, for example, and outputs a signal corresponding to the detected temperature to the ECU 50. With this, the ECU 50 can detect the temperature of the cooling water of the engine 2.

Hereinafter, the abnormality detection processing executed by the ECU 50 according to the present embodiment is described.

In S101, the ECU 50 determines whether the temperature of the cooling water is equal to or more than a predetermined temperature based on the signal from the temperature sensor 62.

In S105 and S108, the ECU 50 determines whether the change rate of the pressure in the atmospheric passage 23 detected by the pressure sensor 61 is changed.

As described above, in the present embodiment, the pressure sensor 61 detects the pressure in the atmospheric passage 23 and outputs the signal corresponding to the detected pressure. Also in the present embodiment, effects similar to those of the first embodiment can be obtained.

In the present embodiment, the abnormality detection portion 54 executes the abnormality detection processing when the temperature of the cooling water of the engine 2 is equal to or more than the predetermined temperature. Thus, the erroneous detection of the clog abnormality can be suppressed.

Other Embodiments

In another embodiment of the present disclosure, the pressure sensor 61 is arranged to detect not only the pressure in the purge passage 22 or the atmospheric passage 23, but also the pressure in the tank passage 21 or the canister 30. However, it is preferable that the pressure sensor 61 is arranged to detect the pressure in other than the tank passage 21, namely the pressure in the purge passage 22, the atmospheric passage 23, or the canister 30 by taking into consideration the tank passage 21 is apt to be clogged.

In the embodiments described above, a configuration in which the abnormality detection portion 54 sets the first time period T1 based on at least one of the amount of the fuel in the fuel tank 11, a kind of the fuel stored in the fuel tank 11, the temperature of the fuel in the fuel tank 11, and the atmospheric pressure is described as an example. However, in another embodiment of the present disclosure, the abnormality detection portion 54 may set the first time period T1 as a predetermined time period.

In the first embodiment described above, the description has been made with an example in which the abnormality detection portion 54 can detect only the clog abnormality in the abnormality detection processing. However, in another embodiment of the present disclosure, the abnormality detection portion 54 may detect the leak abnormality, which is "the abnormality of leakage of the fuel vapor from the fuel tank 11, the tank passage 21, the canister 30, the purge passage 22 or the atmospheric passage 23 to an outside", by comparing the pressure detected by the pressure sensor 61 and the atmospheric pressure in a case in which the abnormality detection portion 54 does not detect the clog abnormality in the abnormality detection processing.

Specifically, the abnormality detection portion 54 determines whether the pressure detected by the pressure sensor 61 is equal to the atmospheric pressure or more than the atmospheric pressure after the predetermined time period has elapsed since the abnormality detection portion 54 determines that "the clog abnormality does not occur". When the abnormality detection portion 54 determines that the pressure detected by the pressure sensor 61 is equal to the atmospheric pressure, the abnormality detection portion 54 detects the leak abnormality. On the other hand, when the abnormality detection portion 54 determines that the pressure detected by the pressure sensor 61 is more than the atmospheric pressure, the abnormality detection portion 54 determines that it is normal without detecting the leak abnormality. In this case, the abnormality detection portion 54 can detect the leak abnormality in addition to the clog abnormality.

In the embodiments described above, the description has been made with an example in which, when the ECU 50 determines NO in S108 or S213, the procedure proceeds to S121 or S221 and the ECU 50 determines that "the clog abnormality does not occur". However, in another embodiment of the present disclosure, when the ECU 50 determines NO in S108 or S213, the procedure may proceed to S120 or S220 and the ECU 50 may detect the clog abnormality.

The embodiments described above may be combined to each other unless there is a hindering factor. For example, after the detection of the clog abnormality is attempted when the pressure in the purge passage 22 is increased as described in the first embodiment, the detection of the clog abnormality may be further attempted when the pressure of the purge passage 22 is decreased as described in the second embodiment. In this case, the detection accuracy of the clog abnormality can be further improved.

In another embodiment of the present disclosure, the tank passage 21 may not be provided with the specific part sp1.

In the embodiments described above, the description has been made with an example in which the tank switch valve 43 is arranged to be contacted with the fuel tank 11 or arranged adjacent to the fuel tank 11. However, in another embodiment of the present disclosure, the tank switch valve 43 may be arranged so as not to be adjacent to the fuel tank 11. In this case, it is preferable that the tank switch valve 43 is arranged near the fuel tank 11 as much as possible.

In this way, the present disclosure is not limited to the embodiments described above, and the present disclosure can be carried out by various configurations within the subject matter of the present disclosure.

What is claimed is:

1. A fuel vapor treatment system that discharges a fuel vapor generated from a fuel evaporated in a fuel tank into an intake passage of an internal combustion engine of a vehicle and processes the fuel vapor, the fuel vapor treatment system comprising:

a tank passage having one end connected to the fuel tank;

a canister that is connected to another end of the tank passage and that absorbs the fuel vapor generated in the fuel tank;

a purge passage having one end connected to the canister and another end connected to the intake passage;

an atmospheric passage having one end connected to the canister and another end communicated with an atmosphere;

a purge valve that opens and closes the purge passage;

an atmospheric valve that opens and closes the atmospheric passage;

a tank switch valve that opens and closes the tank passage;

a pressure sensor that detects pressure in the tank passage, the canister, the purge passage, or the atmospheric passage and outputs a signal corresponding to the detected pressure; and an abnormality detection portion that executes an abnormality detection processing that detects a clog abnormality, which is an abnormality of the tank passage being clogged between the tank switch valve and the canister, based on the signal from the pressure sensor when the tank switch valve is activated in a state in which the purge valve and the atmospheric valve are closed, after the internal combustion engine is stopped.

2. The fuel vapor treatment system according to claim 1, wherein the pressure sensor is arranged to detect the pressure in a clog enabled space, which is defined between the tank switch valve, the purge valve, and the atmospheric valve.

3. The fuel vapor treatment system according to claim 1, wherein the abnormality detection portion executes the abnormality detection processing when a temperature of the fuel in the fuel tank or a temperature of cooling water of the internal combustion engine is equal to or more than a predetermined temperature.

4. The fuel vapor treatment system according to claim 1, wherein, in the abnormality detection processing, when the abnormality detection portion does not detect the clog abnormality, the abnormality detection portion detects a leak abnormality, which is an abnormality of leakage of the fuel vapor from the fuel tank, the tank passage, the canister, the purge passage or the atmospheric passage to an outside, by comparing the pressure detected by the pressure sensor and the atmospheric pressure.

5. The fuel vapor treatment system according to claim 1, wherein, the tank passage has a specific part located lower than a horizontal plane that passes one end of the tank passage or passes the other end of the tank passage in a vertical direction in a state in which the fuel vapor treatment system is mounted in the vehicle.

6. The fuel vapor treatment system according to claim 5, wherein the pressure sensor is arranged to detect the pressure in a space on an opposite side to the fuel tank with respect to the specific part.

7. The fuel vapor treatment system according to claim 5, wherein the tank switch valve is arranged on a side of the fuel tank with respect to the specific part.

8. The fuel vapor treatment system according to claim 1, wherein the tank switch valve is arranged adjacent to the fuel tank.

9. The fuel vapor treatment system according to claim 1, wherein when the clog abnormality occurs, an inside of the tank passage is partially or completely clogged.

10. The fuel vapor treatment system according to claim 1, wherein when the clog abnormality occurs, an inside of the tank passage is partially or completely clogged with liquefied fuel vapor or the foreign substance that retains inside the tank passage and interrupts flow inside the tank passage.

11. A fuel vapor treatment system that discharges a fuel vapor generated from a fuel evaporated in a fuel tank into an intake passage of an internal combustion engine of a vehicle and processes the fuel vapor, the fuel vapor treatment system comprising:

a tank passage having one end connected to the fuel tank;

a canister that is connected to another end of the tank passage and that absorbs the fuel vapor generated in the fuel tank;

a purge passage having one end connected to the canister and another end connected to the intake passage;

an atmospheric passage having one end connected to the canister and another end communicated with an atmosphere;

a purge valve that opens and closes the purge passage;

an atmospheric valve that opens and closes the atmospheric passage;

a tank switch valve that opens and closes the tank passage;

a pressure sensor that detects pressure in the tank passage, the canister, the purge passage, or the atmospheric passage and outputs a signal corresponding to the detected pressure; and an abnormality detection portion that executes an abnormality detection processing that detects a clog abnormality, which is an abnormality of the tank passage being clogged, based on the signal from the pressure sensor when the tank switch valve is activated in a state in which the purge valve and the atmospheric valve are closed, after the internal combustion engine is stopped, wherein, in the abnormality detection processing, the abnormality detection portion closes the tank switch valve at a first time, which is a time when a first time period has elapsed after opening the tank switch valve and closing the purge valve and the atmospheric valve, and when a difference between a change rate of the pressure detected by the pressure sensor before the first time and the change rate of the pressure detected by the pressure sensor after the first time is less than a first predetermined value, the abnormality detection portion detects the clog abnormality, and when the difference between the change rate of the pressure detected by the pressure sensor before the first time and the change rate of the pressure detected by the pressure sensor after the first time is equal to or more than the first predetermined value, the abnormality detection portion does not detect the clog abnormality.

12. The fuel vapor treatment system according to claim 11, wherein the abnormality detection portion sets the first time period, based on at least one of an amount of the fuel in the fuel tank, a kind of the fuel stored in the fuel tank, a temperature of the fuel in the fuel tank, and the atmospheric pressure.

13. The fuel vapor treatment system according to claim 11, wherein, in the abnormality detection processing, the abnormality detection portion opens the tank switch valve at a second time, which is a time when a second time period has elapsed after the first time period elapsed and the tank switch valve is closed, when a difference between the change rate of the pressure detected by the pressure sensor before the second time and the change rate of the pressure detected by the pressure sensor after the second time is less than a second predetermined value, the abnormality detection portion detects the clog abnormality, and when the difference between the change rate of the pressure detected by the pressure sensor before the second time and the change rate of the pressure detected by the pressure sensor after the second time is equal to or more than the second predetermined value, the abnormality detection portion does not detect the clog abnormality.

14. The fuel vapor treatment system according to claim 13, wherein, in the abnormality detection processing, the abnormality detection portion compares the pressure detected by the pressure sensor with an assumed pressure assumed when the clog abnormality does not occur when a third time has elapsed after the second time has elapsed and the tank switch valve is opened, when a difference between the pressure detected by the pressure sensor and the assumed pressure is more than a third predetermined value, the abnormality detection portion detects the clog abnormality, and when the difference between the pressure detected by the pressure sensor and the assumed pressure is equal to or less than the third predetermined value, the abnormality detection portion does not detect the clog abnormality.

* * * * *